US011769515B2

(12) United States Patent
Goodwin et al.

(10) Patent No.: US 11,769,515 B2
(45) Date of Patent: Sep. 26, 2023

(54) AUDIO CODER WINDOW SIZES AND TIME-FREQUENCY TRANSFORMATIONS

(71) Applicant: DTS, Inc., Calabasas, CA (US)

(72) Inventors: Michael M. Goodwin, Scotts Valley, CA (US); Antonius Kalker, Mountain View, CA (US); Albert Chau, Vancouver (CA)

(73) Assignee: DTS, Inc., Calabasas, CA (US)

( * ) Notice: Subject to any disclaimer, the term of this patent is extended or adjusted under 35 U.S.C. 154(b) by 197 days.

(21) Appl. No.: 17/080,548

(22) Filed: Oct. 26, 2020

(65) Prior Publication Data

US 2021/0043218 A1 Feb. 11, 2021

Related U.S. Application Data

(63) Continuation of application No. 15/967,119, filed on Apr. 30, 2018, now Pat. No. 10,818,305.
(Continued)

(51) Int. Cl.
*G10L 19/022* (2013.01)
*G10L 19/008* (2013.01)
(Continued)

(52) U.S. Cl.
CPC ..... *G10L 19/022* (2013.01); *G10L 19/008* (2013.01); *G10L 19/26* (2013.01);
(Continued)

(58) Field of Classification Search
CPC ..... G10L 19/008; G10L 19/0204; G10L 19/0212; G10L 19/022; G10L 19/22; G10L 19/26; G10L 25/18; G10L 25/45
See application file for complete search history.

(56) References Cited

U.S. PATENT DOCUMENTS 5,717,670 A 2/1998 Mitsuno
5,832,437 A 11/1998 Nishiguchi et al.
(Continued)

FOREIGN PATENT DOCUMENTS

CN 101199121 B 3/2012
WO WO-2014053537 A1 4/2014
(Continued)

OTHER PUBLICATIONS

"European Application Serial No. 18789953.9, Extended European Search Report dated Jan. 14, 2021", 7 pgs.
(Continued)

*Primary Examiner* — Eric Yen
(74) *Attorney, Agent, or Firm* — Lerner David LLP

(57) ABSTRACT

A method of encoding an audio signal is provided comprising: applying multiple different time-frequency transformations to an audio signal frame; computing measures of coding efficiency across multiple frequency bands for multiple time-frequency resolutions; selecting a combination of time-frequency resolutions to represent the frame at each of the multiple frequency bands based at least in part upon the computed measures of coding efficiency; determining a window size and a corresponding transform size; determining a modification transformation; windowing the frame using the determined window size; transforming the windowed frame using the determined transform size; modifying a time-frequency resolution within a frequency band of the transform of the windowed frame using the determined modification transformation.

20 Claims, 17 Drawing Sheets

Related U.S. Application Data

(60) Provisional application No. 62/491,911, filed on Apr. 28, 2017.

(51) Int. Cl.

| | |
|---|---|
| ***G10L 19/26*** | (2013.01) |
| ***G10L 25/18*** | (2013.01) |
| ***G10L 25/45*** | (2013.01) |
| ***G10L 19/02*** | (2013.01) |
| ***G10L 19/22*** | (2013.01) |

(52) U.S. Cl.

CPC ..... *G10L 25/18* (2013.01); *G10L 25/45* (2013.01); *G10L 19/0204* (2013.01); *G10L 19/0212* (2013.01); *G10L 19/22* (2013.01)

(56) References Cited

U.S. PATENT DOCUMENTS

| | | | | |
|---|---|---|---|---|
| 6,029,126 | A * | 2/2000 | Malvar | G10L 19/0212 704/E19.02 |
| 6,363,338 | B1 | 3/2002 | Ubale et al. | |
| 7,460,993 | B2 | 12/2008 | Chen et al. | |
| 7,630,902 | B2 | 12/2009 | You | |
| 8,762,159 | B2 | 6/2014 | Geiger et al. | |
| 9,008,811 | B2 | 4/2015 | Valin et al. | |
| 9,093,065 | B2 | 7/2015 | Jax et al. | |
| 9,361,894 | B2 | 6/2016 | You | |
| 9,495,971 | B2 | 11/2016 | Ullberg et al. | |
| 9,508,355 | B2 | 11/2016 | Lee et al. | |
| 10,818,305 | B2 | 10/2020 | Goodwin et al. | |
| 2003/0050786 | A1 | 3/2003 | Jax et al. | |
| 2005/0185850 | A1 | 8/2005 | Vinton et al. | |
| 2005/0231396 | A1 | 10/2005 | Dunn | |
| 2007/0016405 | A1 | 1/2007 | Mehrotra et al. | |
| 2007/0063877 | A1 | 3/2007 | Shmunk et al. | |
| 2007/0067166 | A1* | 3/2007 | Pan | G10L 19/038 704/E19.017 |
| 2007/0094016 | A1 | 4/2007 | Jasiuk et al. | |
| 2007/0100606 | A1 | 5/2007 | Rogers | |
| 2007/0162277 | A1 | 7/2007 | Kurniawati et al. | |
| 2008/0153441 | A1 | 6/2008 | Gibbs | |
| 2009/0012797 | A1* | 1/2009 | Boehm | G10L 19/022 704/E19.02 |
| 2010/0198586 | A1 | 8/2010 | Edler et al. | |
| 2010/0217607 | A1 | 8/2010 | Neuendorf et al. | |
| 2011/0238426 | A1 | 9/2011 | Fuchs et al. | |
| 2011/0257979 | A1 | 10/2011 | Gao | |
| 2012/0069898 | A1* | 3/2012 | Valin | G10L 19/0204 375/240.18 |
| 2012/0232908 | A1* | 9/2012 | Terriberry | G10L 19/022 704/500 |
| 2013/0064383 | A1 | 3/2013 | Schnell et al. | |
| 2013/0332174 | A1 | 12/2013 | Geiger et al. | |
| 2014/0046670 | A1* | 2/2014 | Moon | G10L 19/02 704/500 |
| 2015/0213806 | A1* | 7/2015 | Disch | G10L 19/008 704/500 |
| 2015/0279377 | A1 | 10/2015 | Disch et al. | |
| 2015/0332676 | A1* | 11/2015 | Disch | G10L 21/038 704/500 |
| 2017/0004838 | A1 | 1/2017 | Crockett | |
| 2018/0238943 | A1 | 8/2018 | Bernsee et al. | |
| 2018/0315433 | A1 | 11/2018 | Goodwin et al. | |

FOREIGN PATENT DOCUMENTS

| | | | |
|---|---|---|---|
| WO | WO-2016146265 | A1 | 9/2016 |
| WO | WO-2018201112 | A1 | 11/2018 |

OTHER PUBLICATIONS

Niamut, O A, et al., "Flexible Frequency Decompositions for Cosine-Modulated Filter Banks", Proceedings of International Conference on Acoustics, Speech and Signal Processing, (2003), V_449-V_452.

"U.S. Appl. No. 15/967,119, Non Final Office Action dated Mar. 18, 2020", 28 pgs.

"U.S. Appl. No. 15/967,119, Notice of Allowance dated Jun. 25, 2020", 16 pgs.

"U.S. Appl. No. 15/967,119, Response filed Mar. 2, 2020 to Restriction Requirement dated Jan. 28, 2020", 12 pgs.

"U.S. Appl. No. 15/967,119, Response filed Jun. 18, 2020 to Non Final Office Action dated Mar. 18, 2020", 11 pgs.

"U.S. Appl. No. 15/967,119, Restriction Requirement dated Jan. 28, 2020", 7 pgs.

"International Application Serial No. PCT/US2018/030060, International Preliminary Report on Patentability dated Nov. 7, 2019", 10 pgs.

"International Application Serial No. PCT/US2018/030060, International Search Report dated Jul. 9, 2018", 2 pgs.

"International Application Serial No. PCT/US2018/030060, Written Opinion dated Jul. 9, 2018", 8 pgs.

Princen, J P, et al., "Subband/Transform Coding Using Filter Bank Designs Based on Time Domain Aliasing Cancellation", IEEE Proc. Intl. Conference on Acoustics, Speech, and Signal Processing (ICASSP), (1987), 2161-2164.

U.S. Appl. No. 15/967,119 U.S. Pat. No. 10,818,305, filed Apr. 30, 2018, Audio Coder Window Sizes and Time-Frequency Transformations.

* cited by examiner

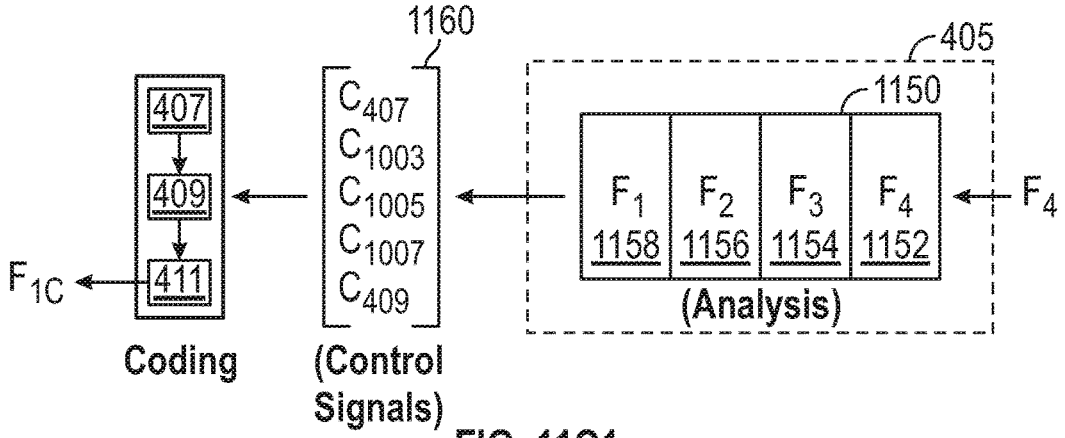
FIG. 11C1
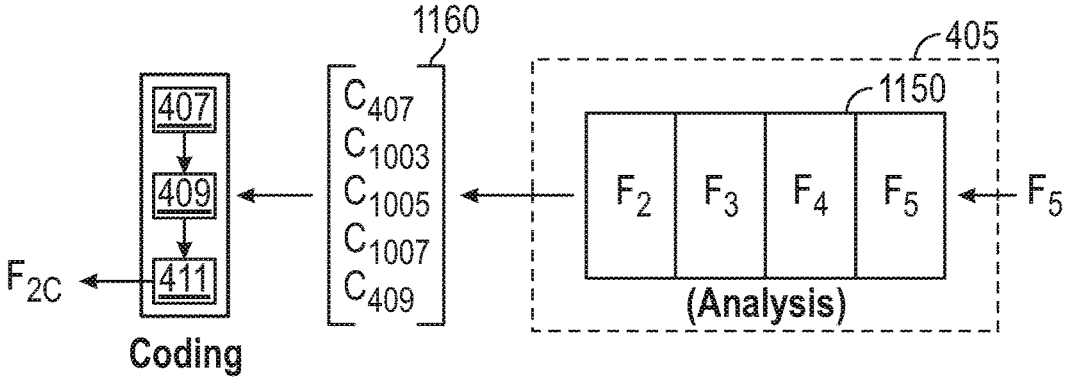
FIG. 11C2
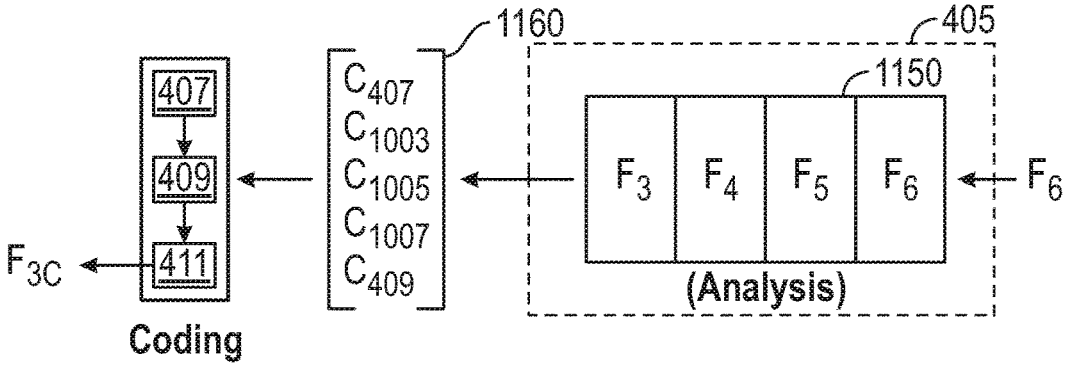
FIG. 11C3
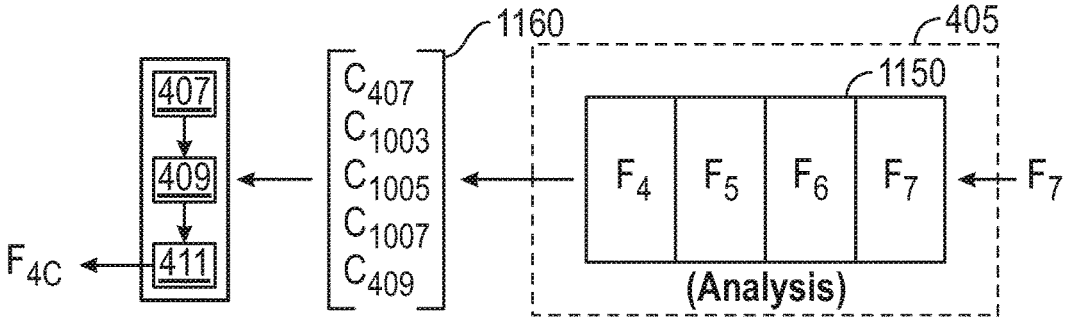
FIG. 11C4

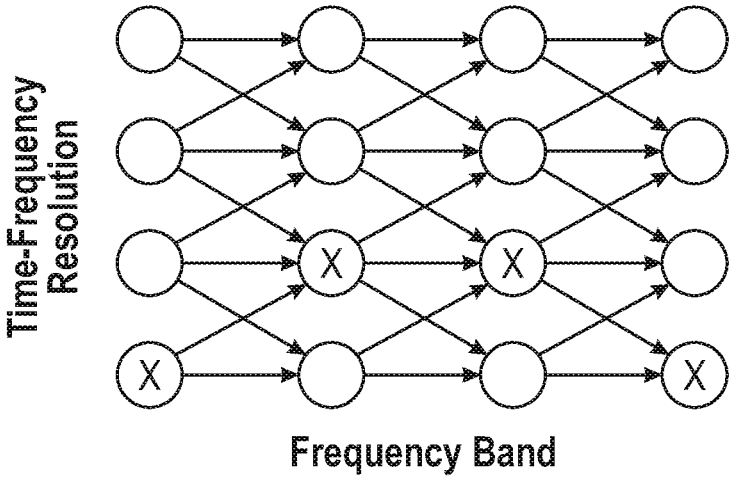
FIG. 13B1
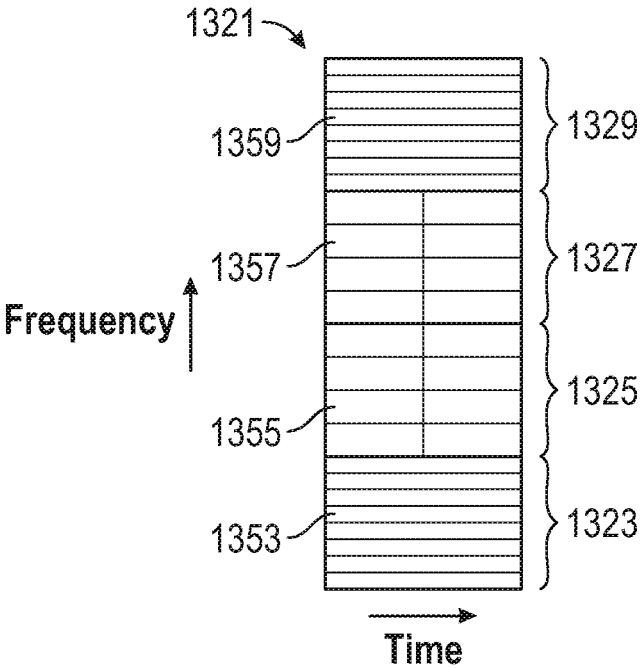
FIG. 13B2

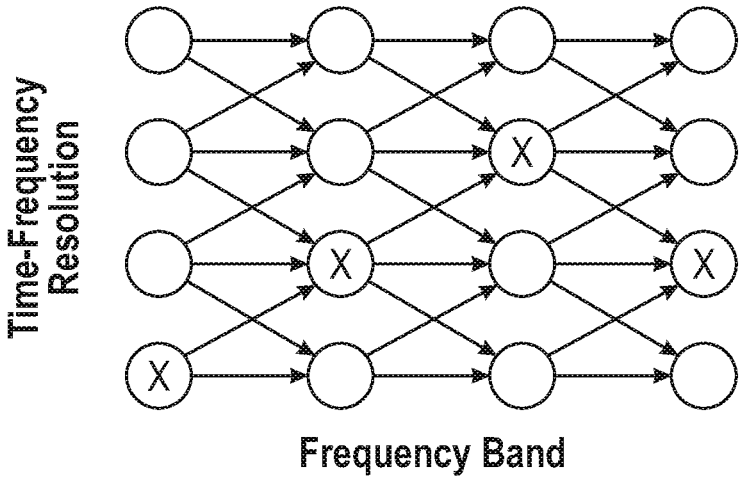
FIG. 13C1
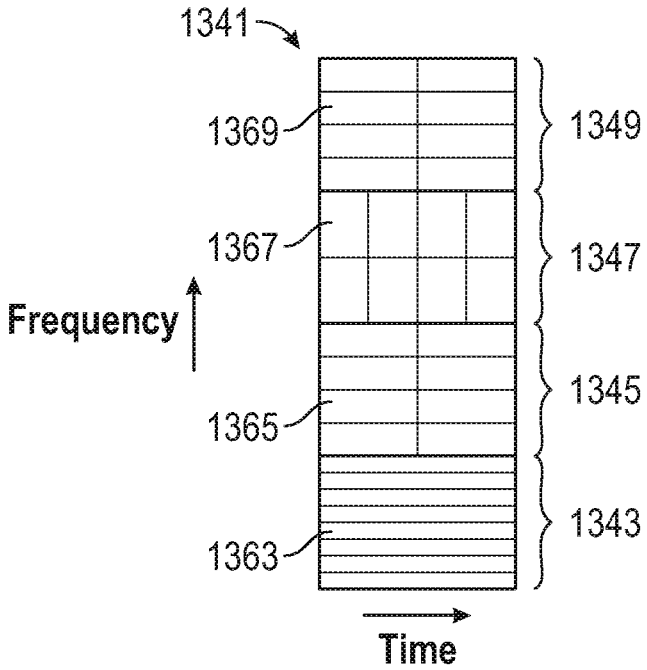
FIG. 13C2

AUDIO CODER WINDOW SIZES AND TIME-FREQUENCY TRANSFORMATIONS

CLAIM OF PRIORITY

This patent application is a Continuation of U.S. patent application Ser. No. 15/967,119, filed on Apr. 30, 2018, which claims the benefit of priority to U.S. Provisional Patent Application No. 62/491,911, filed on Apr. 28, 2017, the contents of which are incorporated by reference herein in their entireties.

BACKGROUND

Coding of audio signals for data reduction is a ubiquitous technology. High-quality, low-bitrate coding is essential for enabling cost-effective media storage and for facilitating distribution over constrained channels (such as Internet streaming). The efficiency of the compression is vital to these applications since the capacity requirements for uncompressed audio may be prohibitive in many scenarios.

Several existing audio coding approaches are based on sliding-window time-frequency transforms. Such transforms convert a time-domain audio signal into a time-frequency representation which is amenable to leveraging psychoacoustic principles to achieve data reduction while limiting the introduction of audible artifacts. In particular, the modified discrete cosine transform (MDCT) is commonly used in audio coders since the sliding-window MDCT can achieve perfect reconstruction using overlapping nonrectangular windows without oversampling, that is, while maintaining the same amount of data in the transform domain as in the time domain; this property is inherently favorable for audio coding applications.

While the time-frequency representation of an audio signal derived by a sliding-window MDCT provides an effective framework for audio coding, it is beneficial for coding performance to extend the framework such that the time-frequency resolution of the representation can be adapted based upon changes or variations in characteristics of the signal to be coded. For instance, such adaptation can be used to limit the audibility of coding artifacts. Several existing audio coders adapt to the signal to be coded by changing the window used in the sliding-window MDCT in response to the signal behavior. For tonal signal content, long windows may be used to provide high frequency resolution; for transient signal content, short windows may be used to provide high time resolution. This approach is commonly referred to as window switching.

Window switching approaches typically provide for short windows, long windows, and transition windows for switching from long to short and vice versa. It is common practice to switch to short windows based on a transient detection process. If a transient is detected in a portion of the audio signal to be coded, that portion of the audio signal is processed using short windows.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one example aspect, a method of encoding an audio signal. Multiple different time-frequency transformations are applied to an audio signal frame across a frequency spectrum to produce multiple transforms of the frame, each transform including a corresponding time-frequency resolution across the frequency spectrum. Measures of coding efficiency are produced across multiple frequency bands within the frequency spectrum, for multiple time-frequency resolutions from among the multiple transforms. A combination of time-frequency resolutions is selected to represent the frame at each of the multiple frequency bands within the frequency spectrum, based at least in part upon the produced measures of coding efficiency. A window size and a corresponding transform size are determined for the frame, based at least in part upon the selected combination of time-frequency resolutions. A modification transformation is determined for at least a one of the frequency bands based at least in part upon the selected combination of time-frequency resolutions and the determined window size. The frame is windowed using the determined window size to produce a windowed frame. The windowed frame is transformed using the determined transform size to produce a transform of the windowed frame that includes a time-frequency resolution at each of the multiple frequency bands of the frequency spectrum. A time-frequency resolution within at least one frequency band of the transform of the windowed frame is modified based at least in part upon the determined modification transformation.

In another example aspect, a method of decoding a coded audio signal is provided. A coded audio signal frame (frame), modification information, transform size information, and window size information are received. A time-frequency resolution within at least one frequency band of the received frame is modified based at least in part upon the received modification information. An inverse transform is applied to the modified frame based at least in part upon the received transform size information. The inverse transformed modified frame is windowed using a window size based at least in part upon the received window size information.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the disclosure.

BRIEF DESCRIPTION OF THE DRAWINGS

Referring now to the drawings in which like reference numbers represent corresponding parts throughout:

FIG. 11C1-11C4 are illustrative functional block diagrams representing a sequence of frames flowing through a pipeline within the analysis block of the encoder of FIG. 4 and illustrating use by the encoder of control information produced based upon the flow.

FIG. 13B1 is an illustrative drawing representing an example first optimal transition sequence across frequency for a single frame through the trellis structure of FIG. 13A.

FIG. 13B2 is an illustrative first time-frequency tile frame corresponding to the first transition sequence across frequency of FIG. 13B1.

FIG. 13C1 is an illustrative drawing representing an example second optimal transition sequence across frequency for a single frame through the trellis structure of FIG. 13A.

FIG. 13C2 is an illustrative second time-frequency tile frame corresponding to the second transition sequence across frequency of FIG. 13C1.

DESCRIPTION OF EMBODIMENTS

In the following description of embodiments of an audio codec and method, reference is made to the accompanying drawings. These drawings shown by way of illustration specific examples of how embodiments of the audio codec system and method may be practiced. It is understood that other embodiments may be utilized and structural changes may be made without departing from the scope of the claimed subject matter.

Sliding-Window MDCT Coder

Figure 1A:
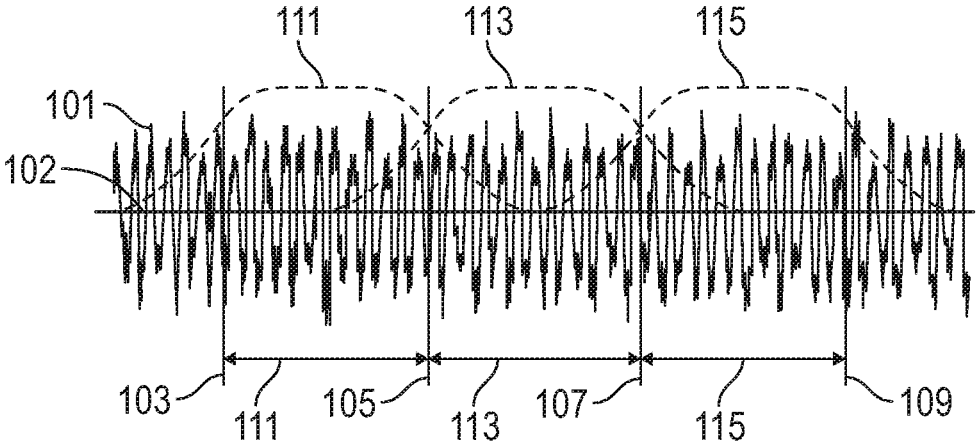
FIG. 1A is an illustrative drawing representing an example of an audio signal segmented into data frames and a sequence of windows that are time-aligned with the audio signal frames.
Figure 1B:
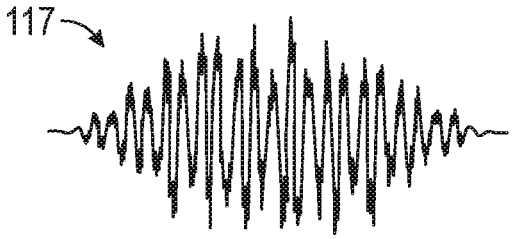
FIG. 1B is an illustrative example windowed signal segment produced by multiplicatively applying a windowing operation to a segment of the audio signal encompassed by the window.

FIGS. 1A-1B are illustrative timing diagrams to portray operation of a windowing circuit block of an encoder 400 described below with reference to FIG. 4. FIG. 1A is an illustrative drawing representing an example of an audio signal segmented into data frames and a sequence of windows time-aligned with the audio signal frames. FIG. 1B is an illustrative example of a windowed signal segment 117 produced by a windowing operation, which multiplicatively applies a window 113 to a segment of the audio signal 101 encompassed by the window 113. A windowing block 407 of the encoder 400 applies a window function to a sequence of audio signal samples to produce a windowed segment. More specifically, the windowing block 407 produces a windowed segment by adjusting values of a sequence of audio signals within a time span encompassed by a time window according to an audio signal magnitude scaling function associated with the window. The windowing block may be configured to apply different windows having different time spans and different scaling functions.

An audio signal 101 denoted with time line 102 may represent an excerpt of a longer audio signal or stream, which may be a representation of time-varying physical sound features. A framing block 403 of the encoder 400 segments the audio signal into frames 120-128 for processing as indicated by the frame boundaries 103-109. The windowing block 407 multiplicatively applies the sequence of windows 111, 113, and 115 to the audio signal to produce windowed signal segments for further processing. The windows are time-aligned with the audio signal in accordance with the frame boundaries. For example, window 113 is time-aligned with the audio signal 101 such that the window 113 is centered on the frame 124 having frame boundaries 105 and 107.

The audio signal 101 may be denoted as a sequence of discrete-time samples x[t] where t is an integer time index. A windowing block audio signal value scaling function, as for example depicted by 111, may be denoted as w[n] where n is an integer time index. The windowing block scaling function may be defined in one embodiment as $$w[n] = \sin\left(\frac{\pi}{N}\left(n + \frac{1}{2}\right)\right) \tag{1}$$

for 0 s n≤N−1 where N is an integer value representing the window time length. In another embodiment, a window may be defined as $$w[n] = \sin\left(\frac{\pi}{N}\sin^2\left(\frac{\pi}{N}\left(n + \frac{1}{2}\right)\right)\right). \tag{2}$$

Other embodiments may perform other windowing scaling functions provided that the windowing function satisfies certain conditions as will be understood by those of ordinary skill in the art. See, J. P. Princen, A. W. Johnson, and A. B. Bradley. Subband/transform coding using filter bank designs based on time domain aliasing cancellation. In *IEE EProc. Intl. Conference on Acoustics, Speech, and Signal Processing* (ICASSP), page 2161-2164, 1987.

A windowed segment may be defined as, $$x_i[n] = w_i[n]x[n+t_i] \tag{3}$$

where i denotes an index for the windowed segment, $w_i[n]$ denotes the windowing function used for the segment, and $t_i$ denotes a starting time index in the audio signal for the segment. In some embodiments, the windowing scaling function may be different for different segments. In other words, different windowing time lengths and different windowing scaling functions may be used for different parts of the signal 101, for example for different frames of the signal or in some cases for different portions of the same frame.

Figure 2:
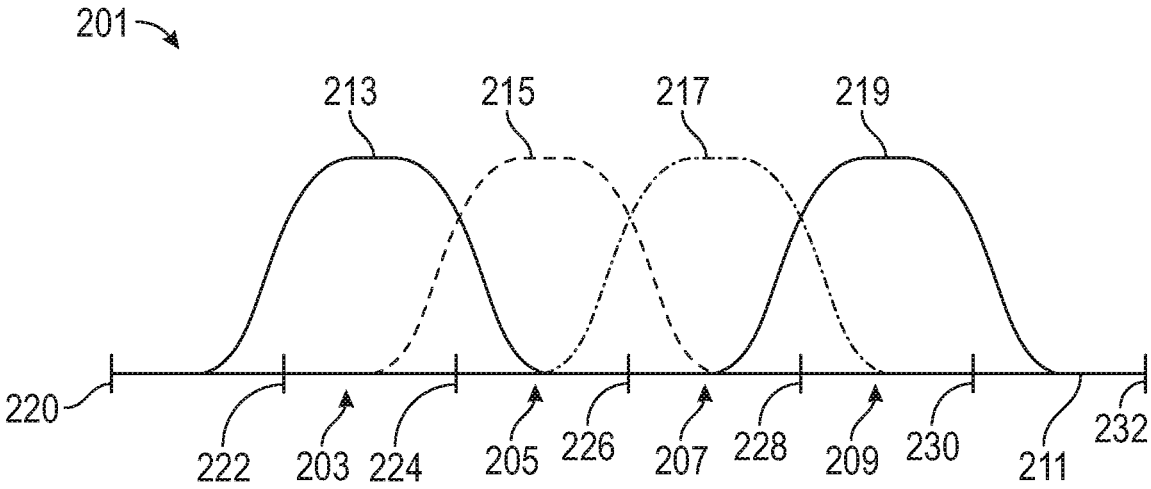
FIG. 2 is an illustrative example signal segmentation diagram showing audio signal frame segmentation and a first sequence of example windows aligned with the frames.

FIG. 2 is an illustrative example of a timing diagram showing an audio signal frame segmentation and a first sequence of example windows aligned with the frames. Frames 203, 205, 207, 209, and 211 are denoted on time line 202. Frame 201 has frame boundaries 220 and 222. Frame 203 has frame boundaries 222 and 224. Frame 205 has frame boundaries 224 and 226. Frame 207 has frame boundaries 226 and 228. Frame 209 has frame boundaries 228 and 230. Windows 213, 215, 217 and 219 are aligned to be time-centered with frames 203, 205, 207, and 209, respectively. In some embodiments, a window such as window 213 which may span an entire frame and may overlap with one or more adjacent frames may be referred to as a long window. In some embodiments, an audio signal data frame such as 203 spanned by a long window may be referred to as a long-window frame. In some embodiments a window sequence such as that depicted in FIG. 2 may be referred to as a long-window sequence.

Figure 3:
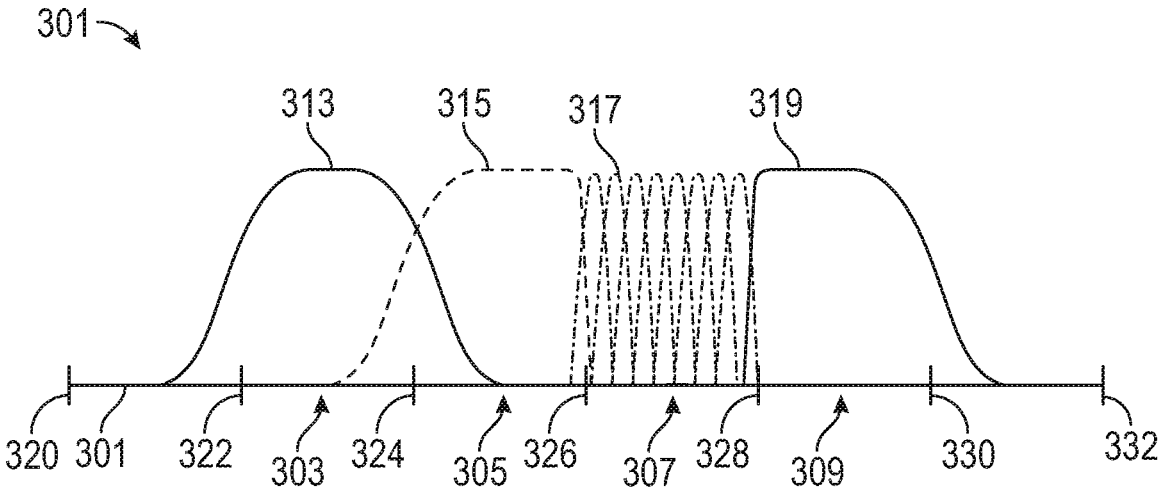
FIG. 3 is an illustrative example of a signal segmentation diagram showing audio signal frame segmentation and a second sequence of example windows time-aligned with the frames.

FIG. 3 is an illustrative example of a timing diagram showing audio signal frame segmentation and a second sequence of example windows time-aligned with the frames. Frames 301, 303, 305, 307, 309 and 311 are denoted on time line 302. Frame 301 has frame boundaries 320 and 322. Frame 303 has frame boundaries 322 and 324. Frame 305 has frame boundaries 324 and 326. Frame 307 has frame boundaries 326 and 328. Frame 309 has frame boundaries 328 and 330. Window functions 313, 315, 317 and 319 are time-aligned with frames 303, 305, 307, and 309, respectively. Window 313, which is time-aligned with frame 303 is an example of a long window function. Frame 307 is spanned by a multiplicity of short windows 317. In some embodiments, a frame such as frame 307, which is time-aligned with multiple short windows, may be referred to as a short-window frame. Frames such as 305 and 309 that respectively precede and follow a short-window frame may be referred as transition frames, and windows such as 315 and 319 that respectively precede and follow a short window may be referred to as transition windows.

In an audio coder based on a sliding-window transform, it may be beneficial to adapt the window and transform size based on the time-frequency behavior of the audio signal. As used herein, especially in the context of the MDCT, the term 'transform size' refers to the number of input data elements that the transform accepts; for some transforms other that the MDCT, e.g. the discrete Fourier transform (DFT), 'transform size' may instead refer to the number of output points (coefficients) that a transform computes. The concept of 'transform size' will be understood by those of ordinary skill in the related art. For tonal signals, the use of long windows (and likewise long-window frames) may improve coding efficiency. For transient signals, the use of short windows (and likewise short-window frames) may limit coding artifacts. For some signals, intermediate window sizes may provide coding advantages. Some signals may display tonal, transient, or yet other behaviors at different times throughout the signal such that the most advantageous window choice for coding may change in time. In such cases, a window-switching scheme may be used wherein windows of different sizes are applied to different segments of an audio signal that have different behaviors, for instance to different audio signal frames, and wherein transition windows are applied to change from one window size to another. In an audio coder, the selection of windows of a certain size in accordance with the audio signal behavior may improve coding performance; coding performance may be referred to as 'coding efficiency' which is used herein to describe how relatively effective a certain coding scheme is at encoding audio signals. If a particular audio coder, say coder A, can encode an audio signal at a lower data rate than a different audio coder, coder B, while introducing the same or fewer artifacts (such as quantization noise or distortion) as coder B, then coder A may be said to be more efficient than coder B. In some cases, 'efficiency' may be used to describe the amount of information in a representation, i.e. 'compactness.' For instance, if a signal representation, say representation A, can represent a signal with less data than a signal representation B but with the same or less error incurred in the representation, we may refer to representation A as being more 'efficient' than representation B.

Figure 4:
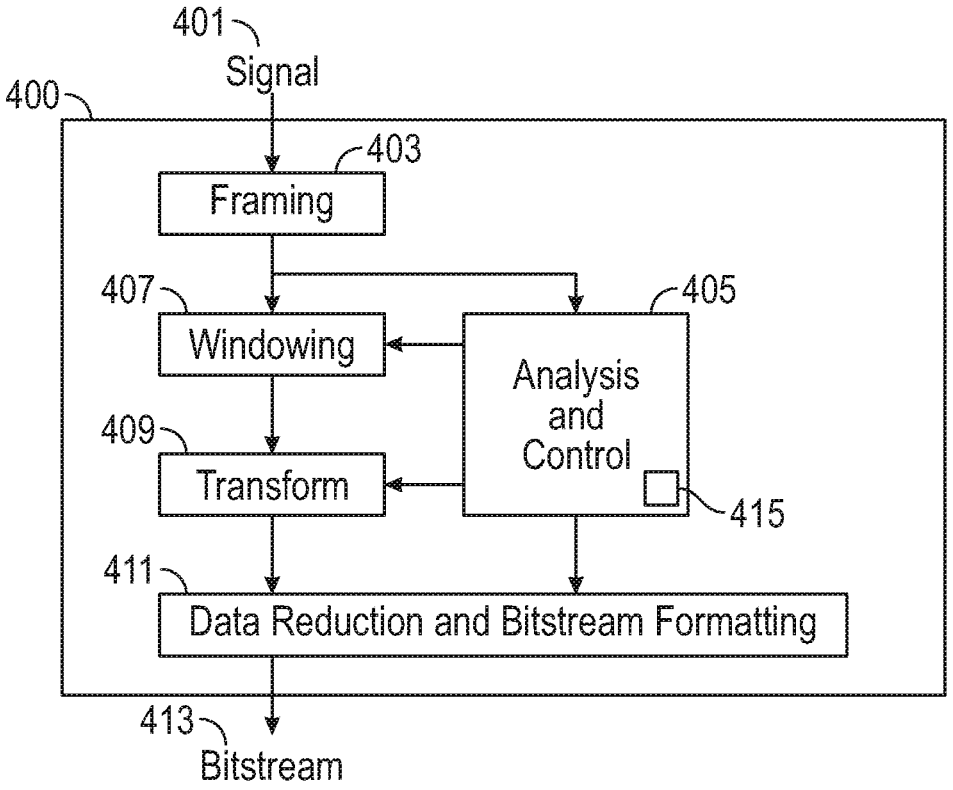
FIG. 4 is an illustrative block diagram showing certain details of an audio encoder accordance with some embodiments.

FIG. 4 is an illustrative block diagram showing certain details of an audio coder 400 in accordance with some embodiments. An audio signal 401 including discrete-time audio samples is input to the coder 400. The audio signal may for instance be a monophonic signal or a single channel of a stereo or multichannel audio signal. A framing circuit block 403 segments the audio signal 401 into frames including a prescribed number of samples; the number of samples in a frame may be referred to as the frame size or the frame length. Framing block 403 provides the signal frames to an analysis and control circuit block 405 and to the windowing circuit block 407. The analysis and control block may analyze one or more frames at a time and provide analysis results and may provide control signals to the windowing block 407, to a transform circuit block 409, and to a data reduction and formatting circuit block 411, based upon analysis results.

The control signals provided to the windowing block 407 based upon the analysis results, may indicate a sequence of windowing operations to be applied by the windowing block 407 to a sequence of frames of audio data. The windowing block 407 produces a windowing signal waveform that includes a sequence of scaling windows. The analysis and control block 405 may cause the windowing block 407 to apply different scaling operations and different window time lengths to different audio frames, based upon different analysis results for the different audio frames, for example. Some audio frames may be scaled according to long windows. Others may be scaled according to short windows and still others may be scaled according to transition windows, for example. In some embodiments, the control block 405 may include a transient detector 415 to determine whether an audio frame contains transient signal behavior. For example, in response to a determination that a frame includes a transient signal behavior, the analysis and control block 405 may provide to the windowing block 407 control signals to indicate that a sequence of windowing operations consisting of short windows should be applied.

The windowing block 407 applies windowing functions to the audio frames to produce windowed audio segments and provides the windowed audio segments to the transform block 409. It will be appreciated that individual windowed time segments may be shorter in time duration than the frame from which they are produced; that is, a given frame may be windowed using multiple windows as illustrated by the short windows 317 of FIG. 3, for example. Control signals provided by the analysis and control block 405 to the transform block 409 may indicate transform sizes for the transform block 409 to use in processing the windowed audio segments based upon the window sizes used for the windowed time segments. In some embodiments, the control signal provided by the analysis and control block 405 to the transform block 409 may indicate transform sizes for frames that are determined to match the window sizes indicated for the frames by control signals provided by the analysis and control block 405 to the windowing block 407. As will be understood by those of ordinary skill in the art, the output of the transform block 409 and results provided by the analysis and control block 405 may be processed by a data reduction and formatting block 411 to generate a coded data bitstream 413 which represents the received input audio signal 401. In some embodiments, the data reduction and formatting may include the application of a psychoacoustic model and information coding principles as will be understood by those of ordinary skill in the art. The audio coder 400 may provide the data bitstream 413 as an output for storage or transmission to a decoder (not shown) as explained below.

The transform block 409 may be configured to carry out a MDCT, which may be defined mathematically as:

$$X_i[k] = \sum_{n=0}^{N-1} x_i[n]\cos\left(\frac{2\pi}{N}\left(n + \frac{N}{4} + \frac{1}{2}\right)\left(k + \frac{1}{2}\right)\right) \tag{4}$$

where $$0 \le k \le \frac{N}{2} - 1$$

and where the values $x_i[n]$ are windowed time samples, i.e. time samples of a windowed audio segment. The values $X_i[k]$ may be referred to generally as transform coefficients or specifically as modified discrete cosine transform (MDCT) coefficients. In accordance with the definition, the MDCT converts N time samples into transform coefficients. For the purposes of this specification, the MDCT as defined above is considered to be of size N. Conversely, an inverse modified discrete cosine transform (IMDCT), which may be performed by a decoder 1600, discussed below with reference to FIG. 16, may be defined mathematically as:

$$\hat{x}_i[n] = \sum_{k=0}^{N/2-1} X_i[k]\cos\left(\frac{2\pi}{N}\left(n + \frac{N}{4} + \frac{1}{2}\right)\left(k + \frac{1}{2}\right)\right) \tag{5}$$

where $0 \le n \le N-1$. As those of ordinary skill in the art will understand, a scale factor may be associated with either the MDCT, the IMDCT, or both. In some embodiments, the forward and inverse MDCT are each scaled by a factor $$\sqrt{\frac{2}{N}}$$

to normalize the result of the applying the forward and inverse MDCT successively. In other embodiments, a scale factor of 2/N may be applied to either the forward MDCT or the inverse MDCT. In yet other embodiments, an alternate scaling approach may be used.

In typical embodiments, a transform operation such as an MDCT is carried out by transform block 409 for each windowed segment of the input signal 401. This sequence of transform operations converts the time-domain signal 401 into a time-frequency representation comprising MDCT coefficients corresponding to each windowed segment. The time and frequency resolution of the time-frequency representation are determined at least in part by the time length of the windowed segment, which is determined by the window size applied by the windowing block 407, and by the size of the associated transform carried out by the transform block 409 on the windowed segment. In accordance with some embodiments size of an MDCT is defined as the number of input samples, and one-half as many transform coefficients are generated as the number of input samples. In an alternative embodiment using other transform techniques, input sample length (size) and corresponding output coefficient number (size) may have a more flexible relationship. For example, a size-8 FFT may be produced based upon a length-32 signal sample.

In some embodiments, a coder 400 may be configured to select among multiple window sizes to use for different frames. The analysis and control block 405 may determine that long windows should be used for frames consisting of primarily tonal content whereas short windows should be used for frames consisting of transient content, for example. In other embodiments, the coder 400 may be configured to support a wider variety of window sizes including long windows, short windows, and windows of intermediate size. The analysis and control block 405 may be configured to select an appropriate window size for each frame based upon characteristics of the audio content (e.g., tonal content, transient content).

In some embodiment, transform size corresponds to window length. For a windowed segment corresponding to a long time-length window, for example, the resulting time-frequency representation has low time resolution but high frequency resolution. For a windowed segment corresponding to a short time-length window, for example, the resulting time-frequency representation has relatively higher time resolution but lower frequency resolution than a time-frequency representation corresponding to a long-window segment. In some cases, a frame of the signal 401 may be associated with more than one windowed segment, as illustrated by the example short windows 317 of the example frame 307 of FIG. 3, which is associated with multiple short windows, each used to produce a windowed segment for a corresponding portion of frame 307.

Examples of Variation of Time-Frequency Resolution Across a Time Sequence of Audio Signal Frames As will be understood by those of ordinary skill in the art, an audio signal frame may be represented as an aggregation of signal transform components, such as MDCT components, for example. This aggregation of signal transform components may be referred to as a time-frequency representation. Furthermore, each of the components in such a time-frequency representation may have specific properties of time-frequency localization. In other words, a certain component may represent characteristics of the audio signal frame which correspond to a certain time span and to a certain frequency range. The relative time span for a signal transform component may be referred to as the component's time resolution. The relative frequency range for a signal transform component may be referred to as the signal transform component's frequency resolution. The relative time span and frequency range may be jointly referred to as the component's time-frequency resolution. As will also be understood by those of ordinary skill in the art, a representation of an audio signal frame may be described as having time-frequency resolution characteristics corresponding to the components in the representation. This may be referred to as the audio signal frame's time-frequency resolution. As will also be understood by those of ordinary skill in the art, a component refers to the function part of the transform, such as a basis vector. A coefficient refers to the weight of that component in a time-frequency representation of a signal. The components of a transform are the functions to which the coefficients correspond. The components are static. The coefficients describe how much of each component is present in the signal.

As will be understood by those of ordinary skill in the art, a time-frequency transform can be expressed graphically as a tiling of a time-frequency plane. The time-frequency representation corresponding to a sequence of windows and associated transforms can likewise be expressed graphically as a tiling of a time-frequency plane. As used herein the term time-frequency tile (hereinafter, 'tile') of an audio signal refers to a "box" which depicts a particular localized time-frequency region of the audio signal, i.e. a particular region of the time-frequency plane centered at a certain time and frequency and having a certain time resolution and frequency resolution, where the time resolution is indicated by the width of the tile in the time dimension (usually the horizontal axis) and the frequency resolution is indicated by the width of the tile in the frequency dimension (usually the vertical axis). A tile of an audio signal may represent a signal transform component e.g., an MDCT component. A tile of a time-frequency representation of an audio signal may be associated with a frequency band of the audio signal. Different frequency bands of a time-frequency representation of an audio signal may comprise similarly or differently shaped tiles i.e. tiles with the same or different time-frequency resolutions. As used herein a time-frequency tiling (hereinafter 'tiling') refers to a combination of tiles of a time-frequency representation, for example of an audio signal. A tiling may be associated with a frequency band of an audio signal. Different frequency bands of an audio signal may have the same or different tilings i.e. the same or different combinations of time-frequency resolutions. A tiling of an audio signal may correspond to a combination of signal transform components, e.g., a combination of MDCT components.

Figure 5A:
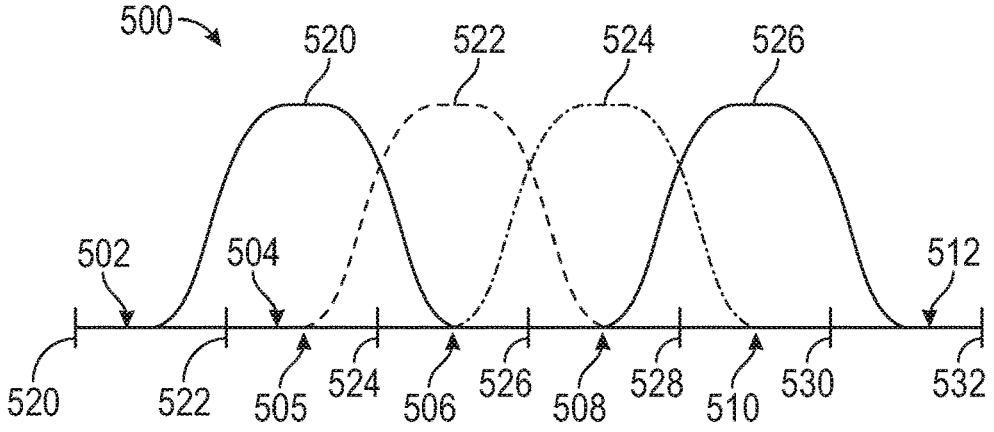
FIG. 5A is an illustrative drawing showing an example signal segmentation diagram that indicates a sequence of audio signal frames and a corresponding sequence of associated long windows.
Figure 5B:
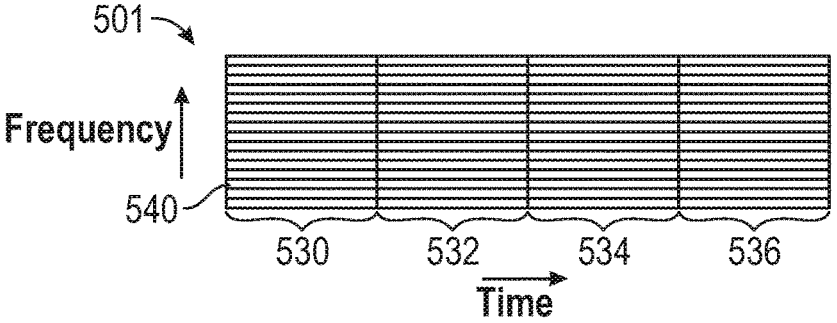
FIG. 5B is an illustrative drawing showing example time-frequency tiles representing time-frequency resolution associated with the sequence of audio signal frames of FIG. 5A.

Thus, each tile in the graphical depictions described in this description indicates a signal transform component and its corresponding time resolution and frequency resolution for that region of the time-frequency representation. Each component in a time-frequency representation of an audio signal may have a corresponding coefficient value; analogously, each tile in a time-frequency tiling of an audio signal may have a corresponding coefficient value. A collection of tiles associated with a frame may be represented as a vector comprising a collection of signal transform coefficients corresponding to components in the time-frequency representation of the signal within the frame. Examples of window sequences and corresponding time-frequency tilings are depicted in FIGS. 5A-5B, 6A-6B, and 7A-7B. FIGS. 5A-5B are illustrative drawings that depict a signal segmentation diagram 500 that indicates a sequence of audio signal frames 502-512 separated in time by a sequence of frame boundaries 520-532 as shown and a corresponding sequence of associated long windows 520-526 (FIG. 5A) and that depict corresponding time-frequency tile frames 530-536 representing time-frequency resolution associated with the sequence of audio signal frames 504-510 (FIG. 5B). Time-frequency tile frame 530 corresponds to signal frame 504; time-frequency tile frame 532 corresponds to signal frame 506; time-frequency tile frame 534 corresponds to signal frame 508; and time-frequency tile frame 536 corresponds to signal frame 510. Referring to FIG. 5A, each of the windows 520-526 represents a long frame. Although each window encompasses portions of more than one audio signal frame, each window is primarily associated with the audio signal frame that is entirely encompassed by the window. Specifically, audio signal frame 504 is associated with window 520. Audio signal frame 506 is associated with window 522. Audio signal frame 508 is associated with window 524. Audio signal frame 510 is associated with window 526.

Referring to FIG. 5B, tile frame 530 represents the time-frequency resolution of a time-frequency representation of audio signal frame 504 corresponding to first applying a long window 520 (e.g. in block 407 of FIG. 4) and then applying an MDCT to the resulting windowed segment (e.g. in block 409 of FIG. 4). Each of the rectangular blocks 540 in tile frame 530 may be referred to as a time-frequency tile or simply as a tile. Each of the tiles 540 in tile frame 530 may correspond to a signal transform component, such as an MDCT component, in the time-frequency representation of audio signal frame 504. As will be understood by those of ordinary skill in the art, in a time-frequency representation of an audio signal frame each component of a signal transform may have a corresponding coefficient. The vertical span of a tile 540 (along the indicated frequency axis) may correspond to the frequency resolution of the tile or equivalently the frequency resolution of the tile's corresponding transform component. The horizontal span of a tile (along the indicated time axis) may correspond to the time resolution of the tile 540 or equivalently the time resolution of the tile's corresponding transform component. A narrower vertical span may correspond to higher frequency resolution whereas a narrower time span may correspond to higher time resolution. It will be understood by those of ordinary skill in the art that the depiction of tile frame 530 may be an illustrative representation of the time-frequency resolution of a time-frequency representation corresponding to audio signal frame 504 with simplifications to reduce the number of tiles depicted so as to render a graphical depiction practical. The illustration of tile frame 530 shows sixteen tiles whereas a typical embodiment of an audio coder may incorporate several hundred components in a time-frequency representation of an audio signal frame.

Tile frame 532 represents the time-frequency resolution of a time-frequency representation of audio signal frame 506. Tile frame 534 represents the time-frequency resolution of a time-frequency representation audio signal frame 508. Tile frame 536 represents the time-frequency resolution of a time-frequency representation of audio signal frame 510. Tile dimensions within tile frames indicate time-frequency resolution. As explained above, tile width in the (vertical) frequency direction is indicative of frequency resolution. The narrower a tile is in the (vertical) frequency direction, the greater the number of tiles aligned vertically, which is indicative of higher frequency resolution. Tile width in the (horizontal) time direction is indicative of time resolution. The narrower a tile is in the (horizontal) time direction, the greater the number of tiles aligned horizontally, which is indicative of higher time resolution. Each of the tile frames 530-536 includes a plurality of individual tiles that are narrow along the (vertical) frequency axis, indicating a high frequency resolution. The individual tiles of tile frames 530-536 are wide along the (horizontal) time axis, indicating a low time resolution. Since all of the tile frames 530-536 have identical tiles that are narrow vertically and wide horizontally, all of the corresponding audio signal frames 504-510 represented by the tile frames 530-536 have the same time-frequency resolution as shown.

Figure 6A:
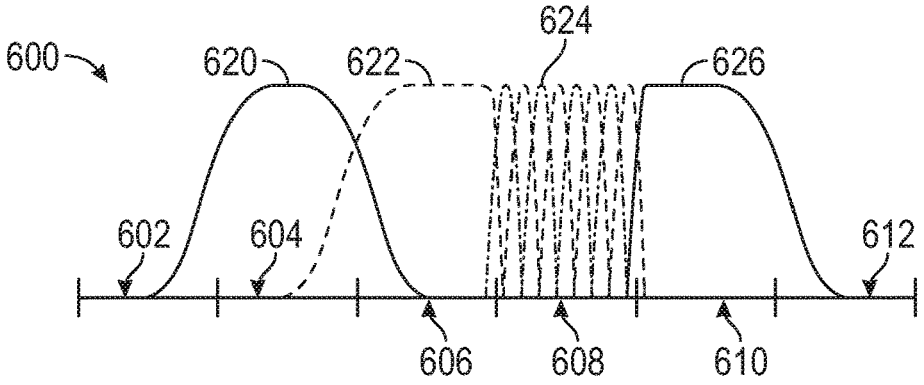
FIG. 6A is an illustrative drawing showing an example signal segmentation diagram that indicates a sequence of audio signal frames and a corresponding sequence of associated long and short windows.
Figure 6B:
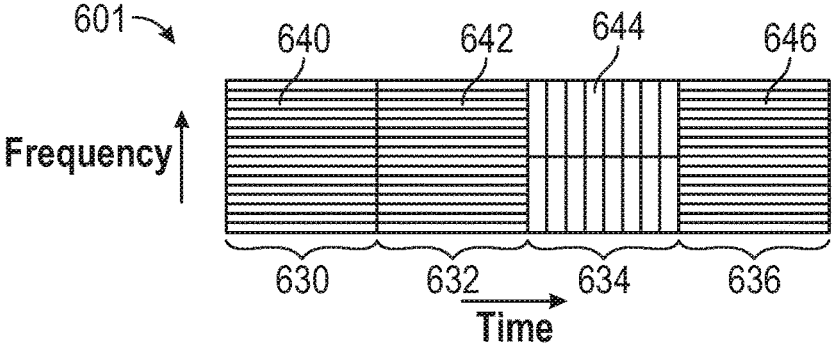
FIG. 6B is an illustrative drawing showing example time-frequency tiles representing time-frequency resolution associated with the sequence of audio signal frames of FIG. 6A.

FIGS. 6A-6B are illustrative drawings that depict a signal segmentation diagram that indicates a sequence of audio signal frames 602-612 and a corresponding sequence of associated windows 620-626 (FIG. 6A) and that depict a sequence of time-frequency tile frames 630-632 representing time-frequency resolution associated with the sequence of audio signal frames 604-610 (FIG. 6B). Referring to FIG. 6A, window 620 represents a long window; corresponding audio frame 604 may be referred to as a long-window frame. Window 624 is a short window; corresponding audio frame 608 may be referred to as a short-window frame. Windows 622 and 626 are transition windows; corresponding audio frames 606 and 610 may be referred to as transition-window frames or as transition frames. The transition frame 606 precedes the short-window frame 608. The transition frame 610 follows the short-window frame 618.

Referring to FIG. 6B, tile frames 630, 632 and 636 have identical time-frequency resolutions and correspond to audio signal frames 604, 606 and 610, respectively. The tiles 640, 642, 646 within tile frames 630, 632 and 636 indicate high frequency resolution and low time resolution. Tile frame 634 corresponds to audio signal frame 624. The tiles 634 within tile frame 634 indicate higher time resolution (are narrower in the time dimension) and lower frequency resolution (are wider in the frequency dimension) than the tiles 640, 642, 646 in the tile frames 630, 632, 636, which correspond to audio signal frames 604, 606, 610 associated respectively with long-windows 620 and transition windows 622, 626 (which have a similar time span as long window 620). In this example, the short-window frame 608 comprises eight windowed segments whereas the long-window and transition-window frames 604, 606, 610 each comprise one windowed segment. The tiles 644 of tile frame 634 are correspondingly eight times wider in the frequency dimension and ⅛th as wide in the time dimension when compared with the tiles 640, 642, 646 of tile frames 630, 632, 636.

Figure 7A:
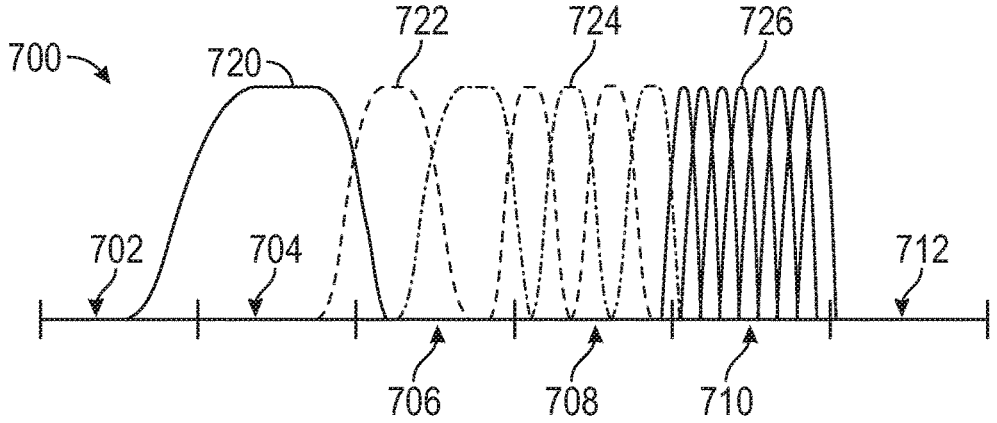
FIG. 7A is an illustrative drawing showing an example signal segmentation diagram that indicates audio signal frames and corresponding windows having various lengths.
Figure 7B:
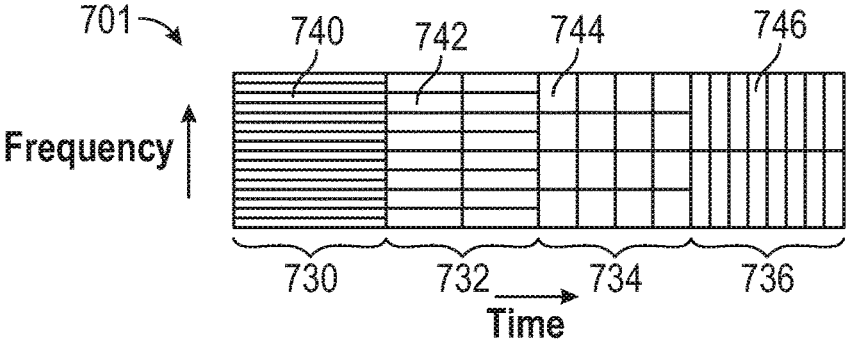
FIG. 7B is an illustrative drawing showing example time-frequency tiles representing time-frequency resolution associated with the sequence of audio signal frames of FIG. 7A, wherein the time-frequency resolution changes from frame to frame but is uniform within each frame.

FIGS. 7A-7B are illustrative drawings that depict a timing diagram that indicates a sequence of audio signal frames 704-710 and a corresponding sequence of associated windows 720-726 (FIG. 7A) and that depict corresponding time-frequency tile frames 730-736 representing time-frequency resolutions associated with the sequence of audio signal frames 704-710 (FIG. 7B). Referring to FIG. 7A, audio signal frame 704 is associated with one window 720. Audio signal frame 706 is associated with two windows 722. Audio signal frame 708 is associated with four windows 724. Audio signal frame 710 is associated with eight windows 726. Thus, it will be appreciated that the number of windows associated with each frame is related to a power of two.

Referring to FIG. 7B, the frequency resolution progressively decreases for the example sequence of tile frames 730-736. Tiles 740 within frame 730 have the highest frequency resolution and tiles 746 within the tile frame 736 have the lowest frequency resolution. Conversely, the time resolution progressively increases for the example sequence of tile frames 730-736. Tiles 740 within frame 730 have the lowest time resolution and tiles 746 within the tile frame 736 have the highest time resolution.

In some embodiments, the coder 400 may be configured to use a multiplicity of window sizes which are not related by powers of two. In some embodiments, it may be preferred to use window sizes related by powers of two as in the example in FIGS. 7A-7B. In some embodiments, using window sizes related by powers of two may facilitate efficient transform implementation. In some embodiments, using window sizes related by powers of two may facilitate a consistent data rate and/or a consistent bitstream format for frames associated with different window sizes.

The time-frequency tile frames depicted in FIGS. 5B, 6B and 7B, and in subsequent figures are intended as illustrative examples and not as literal depictions of the time-frequency representation in typical embodiments. In some embodiments, a long-window segment may consist of 1024 time samples and an associated transform, such as an MDCT, may result in 512 coefficients. A tile frame providing a literal corresponding depiction would show 512 high frequency resolution tiles, which would be impractical for a drawing. As illustrated in FIGS. 7A-7B, configuring an audio coder 400 to use a multiplicity of window sizes provides a multiplicity of possibilities for the time-frequency resolution for each frame of audio. In some cases, depending on the signal characteristics, it may be beneficial to provide further flexibility such that the time-frequency resolution may vary within an individual audio signal frame.

Figure 8A:
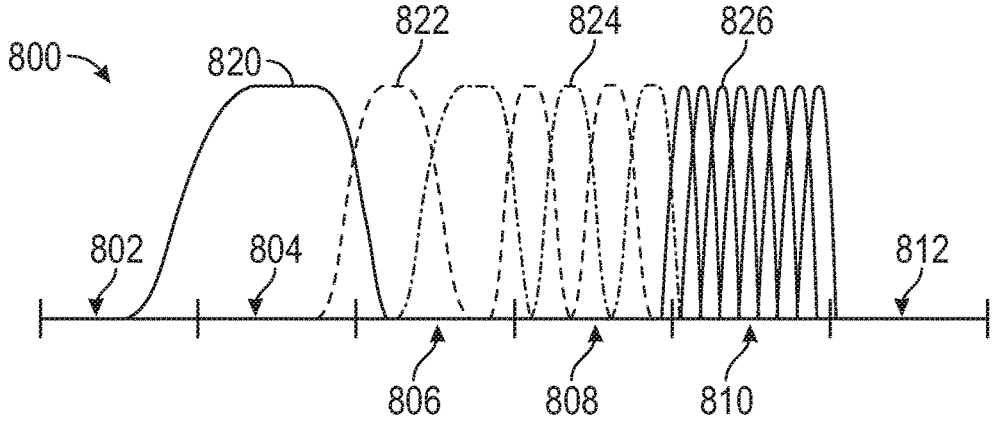
FIG. 8A is an illustrative drawing showing an example signal segmentation diagram that indicates audio signal frames and corresponding windows having various lengths.
Figure 8B:
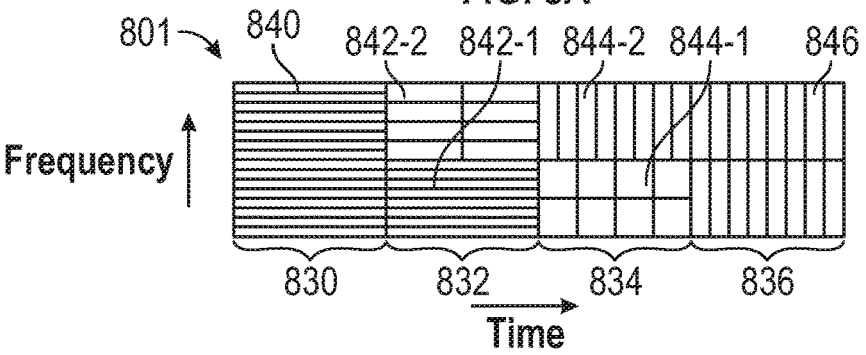
FIG. 8B is an illustrative drawing showing example time-frequency tiles associated with the sequence of audio signal frames of FIG. 8A, wherein the time-frequency resolution changes from frame to frame and is nonuniform within some of the frames.

FIGS. 8A-8B are illustrative drawings that depict a timing diagram that indicates a sequence of audio signal frames 804-810 and a corresponding sequence of associated windows 820-826 (FIG. 8A) and that depict corresponding time-frequency tile frames 830-836 representing time-frequency resolutions associated with the sequence of audio signal frames 804-810. (FIG. 8B). The window sequence 800 of FIG. 8A is identical to the window sequence 700 of FIG. 7A. However, the time-frequency tiling sequence 801 of FIG. 8B is different from the time-frequency tiling sequence 700 of FIG. 7B. The tiles 840 of time-frequency tile frame 830 corresponding to frame 804 in FIGS. 8A-8B consists of uniform high frequency resolution tiles as in the corresponding tile frame 730 corresponding to frame 704 in FIGS. 7A-7B. Similarly, the tiles 846 of time-frequency tile frame 836 corresponding to frame 810 in FIGS. 8A-8B consists of uniform high time resolution tiles as in the corresponding tile frame 736 corresponding to frame 710 in FIGS. 7A-7B. For the tiles 842-1, 842-2 of tile frame 832 corresponding to frame 806, however, the tiling is nonuniform; the low-frequency portion of the region consists of tiles 842-1 with high frequency resolution (as those for audio signal frame 804 and corresponding tile frame 830) whereas the high-frequency portion of the region consists of tiles 842-2 with relatively lower frequency resolution and higher time resolution. For the tile frame region 834 corresponding to audio signal frame 808, the high-frequency portion of the region consists of tiles 844-2 with high time resolution (as those for audio signal frame 810 and corresponding tile frame 836) whereas the low-frequency portion of the region consists of tiles 844-1 with relatively lower time resolution and higher frequency resolution. In some embodiments, an audio coder 400 which may use nonuniform time-frequency resolution within some frames (such as for audio signal frames 806 and 808 in the depiction of FIG. 8) may achieve better coding performance according to typical coding performance metrics than a coder restricted to uniform time-frequency resolution for each frame.

As depicted in FIGS. 7A-7B, an audio signal coder 400 may provide a variable-size windowing scheme in conjunction with a correspondingly sized MDCT to provide tile frames that are variable from frame to frame but which have uniform tiles within each tile frame. As explained above with respect to FIGS. 8A-8B, an audio signal coder 400 may provide tile frames having nonuniform tiles within some tile frames depending on the audio signal characteristics. In embodiments, which use a variable window size and a correspondingly sized MDCT, a nonuniform time-frequency tiling can be realized within the time-frequency region corresponding to an audio frame by processing the transform coefficient data for that frame in a prescribed manner as will be explained below. As will be understood by those of ordinary skill in the art, a nonuniform time-frequency tiling may alternatively be realized using a wavelet packet filter bank, for example.

Modification of Time-Frequency Resolution of an Audio Signal Frame

Figure 9:
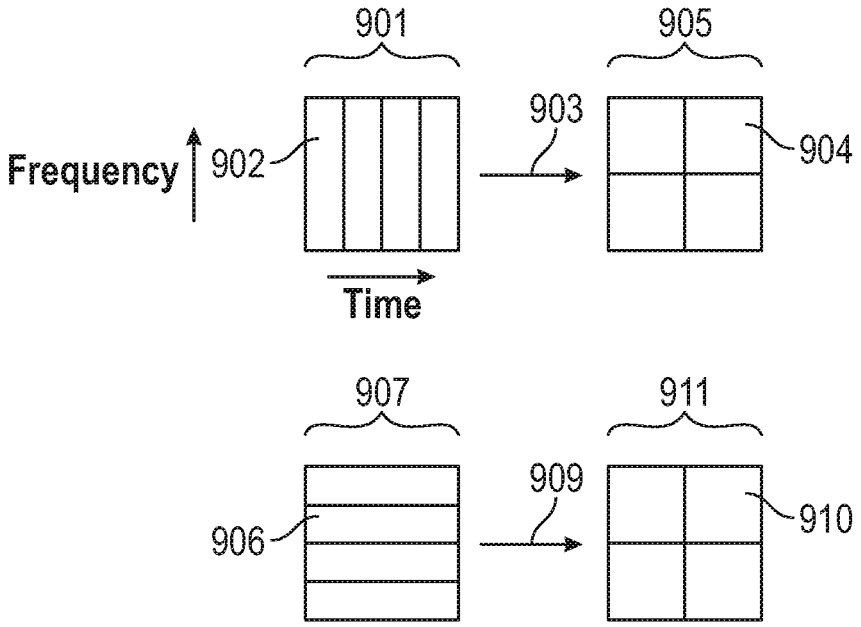
FIG. 9 is an illustrative drawing that depicts two illustrative examples of a tile frame time-frequency resolution modification process.

As will be understood by those of ordinary skill in the art, the time-frequency resolution of an audio signal representation may be modified by applying a time-frequency transformation to the time-frequency representation of the signal. The modification of the time-frequency resolution of an audio signal may be visualized using time-frequency tiles. FIG. 9 is an illustrative drawing that depicts two illustrative examples of a time-frequency resolution modification process for a time-frequency tile frame. In some embodiments, time-frequency tile frames and associated time-frequency transformations may be more complex than the examples depicted in FIG. 9, although the methods described in the context of FIG. 9 may still be applicable.

Tile frame 901 represents an initial time-frequency tile frame consisting of tiles 902 with higher time resolution and lower frequency resolution. For the purposes of explanation, the corresponding signal representation may be expressed as a vector (not shown) consisting of four elements. In one embodiment, the resolution of the time-frequency representation may be modified by a time-frequency transformation process 903 to yield a time-frequency tile frame 905 consisting of tiles 904 with lower time resolution and higher frequency resolution. In some embodiments, this transformation may be realized by a matrix multiplication of the initial signal vector. Denoting the initial representation by $\vec{X}$ and the modified representation by $\vec{Y}$, the time-frequency transformation process 903 may be realized in one embodiment as $$\vec{Y} = \begin{bmatrix} 1 & 1 & 0 & 0 \\ 0 & 0 & 1 & 1 \\ 1 & -1 & 0 & 0 \\ 0 & 0 & 1 & -1 \end{bmatrix} \vec{X} \tag{6}$$

where the matrix is based in part on a Haar analysis filter bank, which may be implemented using matrix transformations, as will be understood by those of ordinary skill in the art. In other embodiments, alternate time-frequency transformations such as a Walsh-Hadamard analysis filter bank, which may be implemented using matrix transformations, may be used. In some embodiments, the dimensions and structure of the transformation may be different depending on the desired time-frequency resolution modification. As those of ordinary skill in the art will understand, in some embodiments alternate transformations may be constructed based in part on iterating a two-channel Haar filter bank structure.

As another example, an initial time-frequency tile frame 907 represents a simple time-frequency tiling consisting of tiles 906 with higher frequency resolution and lower time resolution. For the purposes of explanation, the corresponding signal representation may be expressed as a vector (not shown) consisting of four elements. In one embodiment, the resolution of the tile frame 907 may be modified by a time-frequency transformation process 909 to yield a modified time-frequency tile frame 911 consisting of tiles 910 with higher time resolution and lower frequency resolution. As above, this transformation may be realized by a matrix multiplication of the initial signal vector. Denoting again the initial representation by $\vec{X}$ and the modified representation by $\vec{Y}$, the time-frequency transformation 909 may be realized in one embodiment as $$\vec{Y} = \begin{bmatrix} 1 & 1 & 0 & 0 \\ 1 & -1 & 0 & 0 \\ 0 & 0 & 1 & 1 \\ 0 & 0 & 1 & -1 \end{bmatrix} \vec{X} \tag{7}$$

where the matrix is based in part on a Haar synthesis filter bank as will be understood by those of ordinary skill in the art. In other embodiments, alternate time-frequency transformations such as a Walsh-Hadamard synthesis filter bank, which may be implemented using matrix transformations, may be used. In some embodiments, the dimensions and structure of the time-frequency transformation may be different depending on the desired time-frequency resolution modification. As those of ordinary skill in the art will understand, in some embodiments alternate time-frequency transformations may be constructed based in part on iterating a two-channel Haar filter bank structure.

Certain Transform Block Details

Figure 10A:
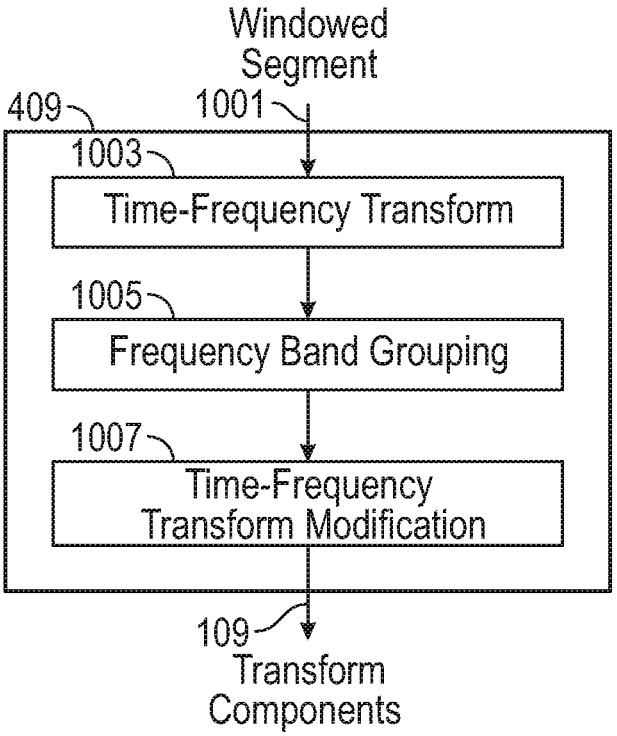
FIG. 10A is an illustrative block diagram showing certain details of a transform block of the encoder of FIG. 4.

FIG. 10A is an illustrative block diagram showing certain details of a transform block 409 of the encoder 400 of FIG. 4. In some embodiments, the analysis and control block 405 may provide control signals to configure the windowing block 407 to adapt a window length for each audio signal frame, and to also configure time-frequency transformation block 1003 to apply a corresponding transform, such as an MDCT, with a transform size based upon the window length, to each windowed audio segment output by windowing block 407. A frequency band grouping block 1005 groups the signal transform coefficients for the frame. The analysis and control block 405 configures a time-frequency transformation modification block 1007 to modify the signal transform coefficients within each frame as explained more fully below.

More particularly, the transform block 409 of the encoder 400 of FIG. 4 may comprise several blocks as illustrated in the block diagram of FIG. 10A. In some embodiments, for each frame the windowing block 407 provides one or more windowed segments as input 1001 to the transform block 409. The time-frequency transform block 1003 may apply a transform such as an MDCT to each windowed segment to produce signal transform coefficients, such as MDCT coefficients, representing the one or more windowed segments, where each transform coefficient corresponds to a transform component as will be understood by those of ordinary skill in the art. As explained more fully below, the size of the time-frequency transform imparted to a windowed segment by the time-frequency transform block 1003 is dependent upon the size of the windowed segment 1001 provided by the windowing block 407. The frequency band grouping block 1005 may arrange the signal transform coefficients, such as MDCT coefficients, into groups according to frequency bands. As an example, MDCT coefficients corresponding to a first frequency band including frequencies in the 0 to 1 kHz range may be grouped into a frequency band. In some embodiments, the group arrangement may be in vector form. For example, the time-frequency transform block 1003 may derive a vector of MDCT coefficients corresponding to certain frequencies (say 0 to 24 kHz). Adjacent coefficients in the vector may correspond to adjacent frequency components in the time-frequency representation. The frequency band grouping block 1005 may establish one or more frequency bands, such as a first frequency band 0 to 1 kHz, a second frequency band 1 kHz to 2 kHz, a third frequency band 2 kHz to 4 kHz, and a fourth frequency band 4 kHz to 6 kHz, for example. In frequency band groupings for frames comprising multiple windows and multiple corresponding transforms, adjacent coefficients in the vector may correspond to like frequency components at adjacent times, i.e. corresponding to the same frequency component of successive MDCTs applied across the frame.

The time-frequency transformation modification block 1007 may perform time-frequency transformations on the frequency band groups in a manner generally described above with reference to FIG. 9. In some embodiments, the time-frequency transformations may involve matrix operations. Each frequency band may be processed with a transformation in accordance with control information (not shown in FIG. 10A) indicating what kind of time-frequency transformation to carry out on each frequency-band group of signal transform coefficients, which may be derived by the analysis and control block 405 and supplied to the time-frequency transform modification block 1007. The processed frequency band data may be provided at the output 1009 of the transform block 409. In the context of the audio coder 400, in some embodiments, information related to the window size, the MDCT transform size, the frequency band grouping, and the time-frequency transformations may be encoded in the bitstream 413 for use by the decoder 1600.

In some embodiments, the audio coder 400 may be configured with a control mechanism to determine an adaptive time-frequency resolution for the encoder processing. In such embodiments, the analysis and control block 405 may determine windowing functions for windowing block 407, transform sizes for time-frequency transform block 1003, and time-frequency transformations for time-frequency transformation modification block 1007. As explained with reference to FIG. 10B, the analysis and control block 405 produces multiple alternative possible time-frequency resolutions for a frame and selects a time-frequency resolution to be applied to the frame based upon an analysis that includes a comparison of coding efficiencies of the different-possible time-frequency resolutions.

Analysis Block Details

Figure 10B:
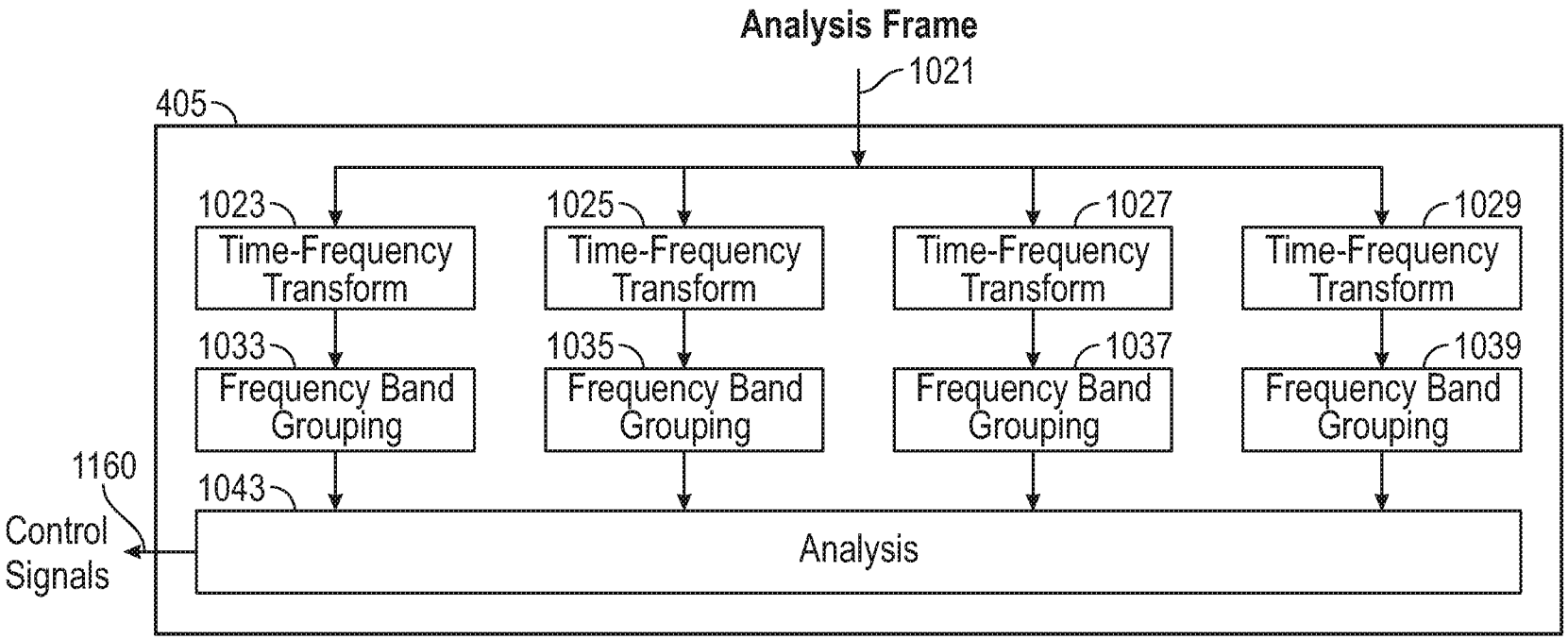
FIG. 10B is an illustrative block diagram showing certain details of an analysis and control block of the encoder of FIG. 4.

FIG. 10B is an illustrative block diagram showing certain details of the analysis and control block 405 of the encoder 400 of FIG. 4. The analysis and control block 405 receives as input an analysis frame 1021 and provides control signals 1160 described more fully below. In some embodiments, the analysis frame may be a most recently received frame provided by the framing block 403. The analysis and control block 405 may include multiple time-frequency transform analysis blocks 1023, 1025, 1027, 1029 and multiple frequency band grouping blocks 1033, 1035, 1037, 1039. The analysis and control block 405 may also include an analysis block 1043.

The analysis and control block 405 performs multiple different time-frequency transforms with different time-frequency resolutions on the analysis frame 1021. More specifically, first, second, third and fourth time-frequency transform analysis blocks 1023, 1025, 1027 and 1029 perform different respective first, second, third and fourth time-frequency transformations of the analysis frame 1021. The illustrative drawing of FIG. 10B depicts four different time-frequency transform analysis blocks as an example. In some embodiments, each of the multiple time-frequency transform analysis blocks applies a sliding-window transform with a respective selected window size to the analysis frame 1021 to produce multiple respective sets of signal transform coefficients, such as MDCT coefficients. In the example depicted in FIG. 10B, blocks 1023-1029 may each apply a sliding-window MDCT with a different window size. In other embodiments, alternate time-frequency transforms with time-frequency resolutions approximating sliding-window MDCTs with different window sizes may be used.

First, second, third and fourth frequency band grouping blocks 1033-1039 may arrange the time-frequency signal transform coefficients (derived respectively by blocks 1023-1029), which may be MDCT coefficients, into groups according to frequency bands. The frequency band grouping may be represented as a vector arrangement of the transform coefficients organized in a prescribed fashion. For example, when grouping coefficients for a single window, the coefficients may be arranged in frequency order. When grouping coefficients for more than one window (e.g. when there is more than one set of signal transform coefficients, such as coefficients, computed—one for each window), the multiple sets of transform outputs may be rearranged into a vector with like frequencies adjacent to each other in the vector and arranged in time order (in the order of the sequence of windows to which they correspond). While FIG. 10B depicts four different time-frequency transform blocks 1023-1029 and four corresponding frequency band grouping blocks 1033-1039, some embodiments may use a different number of transform and frequency band grouping blocks, for instance two, four, five, or six.

The frequency-band groupings of time-frequency transform coefficients corresponding to different time-frequency resolutions may be provided to the analysis block 1043 configured according to a time-frequency resolution analysis process. In some embodiments, the analysis process may only analyze the coefficients corresponding to a single analysis frame. In some embodiments, the analysis process may analyze the coefficients corresponding to a current analysis frame as well as frames of preceding frames. In some embodiments, the analysis process may employ an across-time trellis data structure and/or an across-frequency trellis data structure, as described below, to analyze coefficients across multiple frames. The analysis and control block 405 may provide control information for processing of an encoding frame. In some embodiments, the control information may include windowing functions for the windowing block 407, transform sizes (e.g. MDCT sizes) for block 1003 of transform block 409 of the encoder 400, and local time-frequency transformations for modification block 1007 of transform block 409 of the encoder 400. In some embodiments, the control information may be provided to block 411 for inclusion in the encoder output bitstream 413.

Figure 10C:
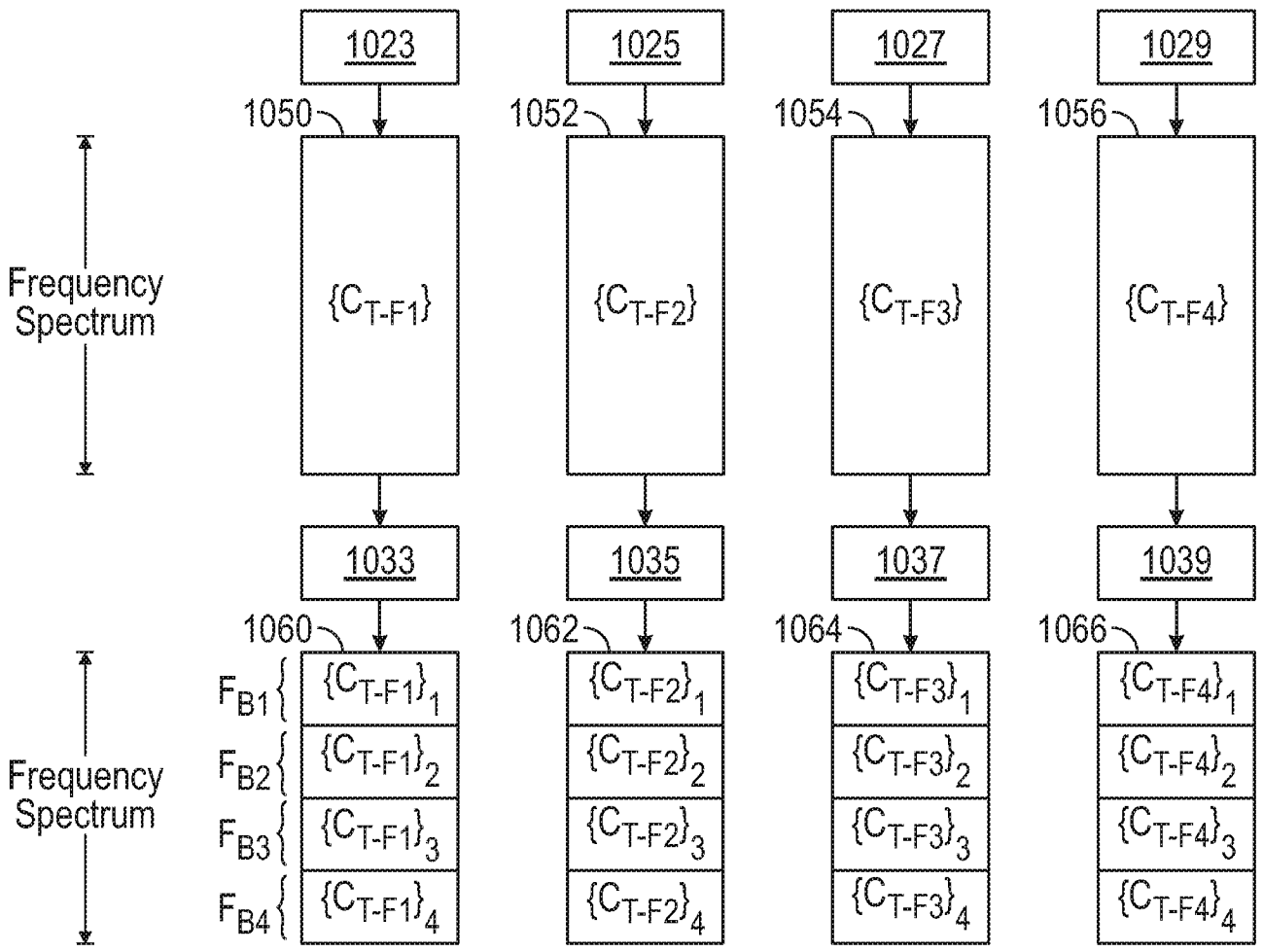
FIG. 10C is an illustrative functional block diagram representing the time-frequency transformations by time-frequency transform blocks and frequency band-based time-frequency transform coefficient groupings by frequency band grouping blocks of FIG. 10B.

FIG. 10C is an illustrative functional block diagram representing the time-frequency transforms by the time-frequency transform blocks 1023-1029 and frequency band-based time-frequency transform coefficient groupings by frequency band grouping blocks 1033-1039 of FIG. 10B. The first time-frequency transform analysis block 1023 performs a first time-frequency transform of the analysis frame 1021 across an entire frequency spectrum of interest (F) to produce a first time-frequency transform frame 1050 that includes a first set of signal transform coefficients (e.g., MDCT coefficients) $\{C_{T\text{-}F1}\}$. The first time-frequency transform may, for example, correspond to the time-frequency resolution of tiles 740 of frame 730 of FIG. 7, for example. The first frequency band grouping block 1033 produces a first grouped time-frequency transform frame 1060 by grouping the first set of signal transform coefficients $\{C_{T\text{-}F1}\}_2$ of the first time-frequency transformation frame 1050 into multiple (e.g., four) frequency bands FB1-FB4 such that a first subset $\{C_{T\text{-}F1}\}_1$ of the first set of signal transform coefficients is grouped into a first frequency band FB1; a second subset $\{C_{T\text{-}F1}\}_2$ of the first set of signal transform coefficients is grouped into a second frequency band FB2; a third subset $\{C_{T\text{-}F1}\}_3$ of the first set of signal transform coefficients is grouped into a third frequency band FB3; and a fourth subset $\{C_{T\text{-}F1}\}_4$ of the first set of signal transform coefficients is grouped into a fourth frequency band FB4.

Similarly, the second time-frequency transform analysis block 1025 performs a second time-frequency transform of the analysis frame 1021 across an entire frequency spectrum of interest (F) to produce a second time-frequency transform frame 1052 that includes a second set of signal transform coefficients (e.g., MDCT coefficients) $\{C_{T\text{-}F2}\}$. The second time-frequency transform may, for example, correspond to the time-frequency resolution of tiles 742 of frame 732 of FIG. 7B, for example. The second frequency band grouping block 1033 produces a second grouped time-frequency transform frame 1062 by grouping the first set of signal transform coefficients $\{C_{T\text{-}F2}\}$ of the second time-frequency transform frame 1052 into a first subset $\{C_{T\text{-}F2}\}$) of the second set of signal transform coefficients grouped into the first frequency band FB1; a second subset $\{C_{T\text{-}F2}\}_2$ of the second set of signal transform coefficients grouped into a second frequency band FB2; a third subset $\{C_{T\text{-}F2}\}_3$ of the third set of signal transform coefficients grouped into a third frequency band FB3; and a fourth subset $\{C_{T\text{-}F2}\}_4$ of the second set of signal transform coefficients grouped into a fourth frequency band FB4.

Likewise, the third time-frequency transform analysis block 1027 similarly performs a fourth time-frequency transform to produce a third time-frequency transform frame 1054 that includes a third set of signal transform components $\{C_{T\text{-}F3}\}$. The third time-frequency transform may, for example, correspond to the time-frequency resolution of tiles 744 of frame 734 of FIG. 7, for example. The third frequency band grouping block 1037 similarly produces a third grouped time-frequency transform frame 1064 by grouping first through fourth subsets $\{C_{T\text{-}F3}\}_1$, $\{C_{T\text{-}F3}\}_2$, $\{C_{T\text{-}F3}\}_3$, and $\{C_{T\text{-}F3}\}_4$ of the third set of signal transform coefficients into the first through fourth frequency bands FB1-FB4.

Finally, the fourth time-frequency transform analysis block 1029 similarly performs a fourth time-frequency transform to produce a fourth time-frequency transform frame 1056 that includes a fourth set of signal transform components $\{C_{T\text{-}F4}\}$. The fourth time-frequency transform may, for example, correspond to the time-frequency resolution of tiles 746 of frame 736 of FIG. 7, for example. The fourth frequency band grouping block 1039 similarly produces a fourth grouped time-frequency transform frame 1066 by grouping first through fourth subsets $\{C_{T\text{-}F4}\}_1$, $\{C_{T\text{-}F4}\}_2$, $\{C_{T\text{-}F4}\}_3$, and $\{C_{T\text{-}F4}\}_4$ of the fourth set of signal transform coefficients of the fourth time-frequency transform frame 1056 into the first through fourth frequency bands FB1-FB4.

Thus, it will be appreciated that in the example embodiment of FIG. 10C, the time-frequency transform blocks 1023-1029 and the frequency band grouping blocks 1033-1039 produce a multiplicity of sets of time-frequency signal transform coefficients for the analysis frame 1021, with each set of coefficients corresponding to a different time-frequency resolution. In some embodiments, the first time-frequency transform analysis block 1023 may produce a first set of signal transform coefficients $\{C_{T\text{-}F1}\}$ with the highest frequency resolution and the lowest time resolution among the multiplicity of sets. In some embodiments, the fourth time-frequency transform analysis block 1029 may produce a fourth set of signal transform coefficients $\{C_{T\text{-}F4}\}$ with the lowest frequency resolution and the highest time resolution among the multiplicity of sets. In some embodiments, the second time-frequency transform analysis block 1025 may produce a second set of signal transform coefficients $\{C_{T\text{-}F2}\}$ with a frequency resolution lower than that of the first set $\{C_{T\text{-}F1}\}$ and higher than that of the third set $\{C_{T\text{-}F3}\}$ and with a time resolution higher than that of the first set $\{C_{T\text{-}F1}\}$ and lower than that of the third set $\{C_{T\text{-}F3}\}$. In some embodiments, the third time-frequency transform analysis block 1027 may produce a third set of signal transform coefficients $\{C_{T\text{-}F3}\}$ with a frequency resolution lower than that of the second set $\{C_{T\text{-}F2}\}$ and higher than that of the fourth set $\{C_{T\text{-}F4}\}$ and with a time resolution higher than that of the second set $\{C_{T\text{-}F2}\}$ and lower than that of the fourth set $\{C_{T\text{-}F4}\}$.

Figure 11A:
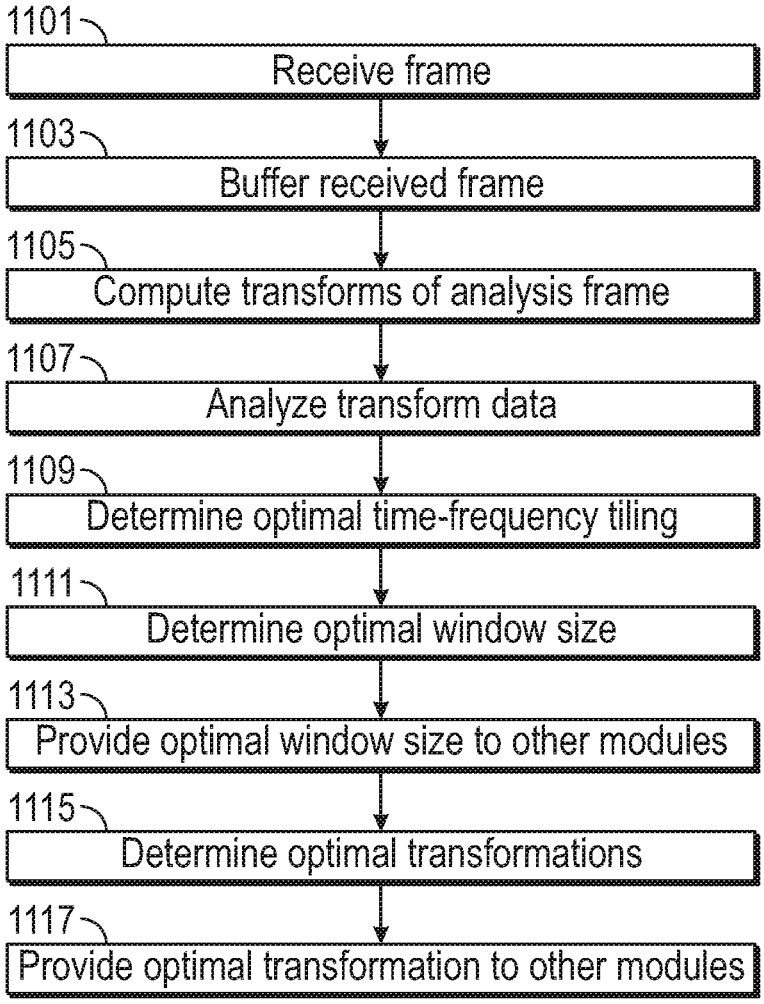
FIG. 11A is an illustrative control flow diagram representing a configuration of the analysis and control block of FIG. 10B to determine time-frequency resolutions and window sizes for frames of a received audio signal.
Figure 11B:
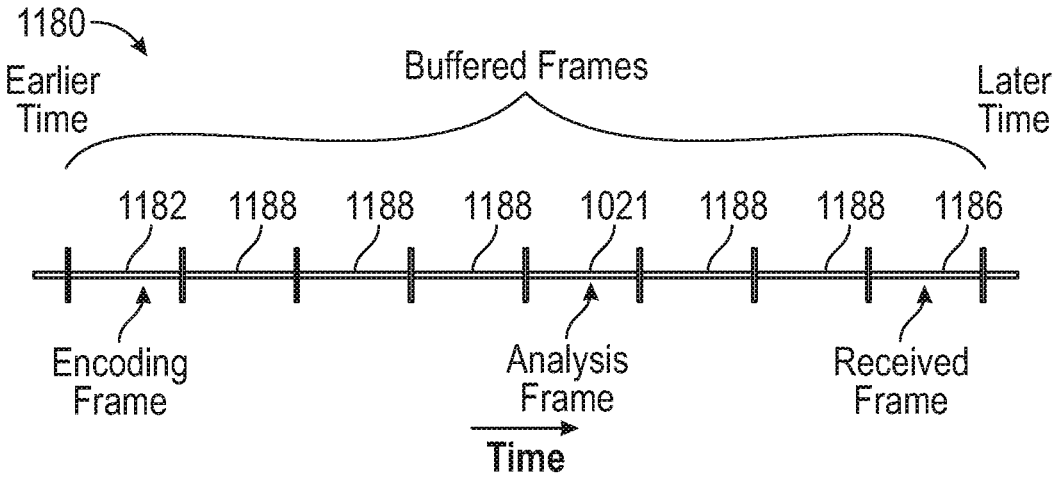
FIG. 11B is an illustrative drawing representing a sequence of audio signal data frames that includes an encoding frame, an analysis frame and intermediate buffered frames.

FIG. 11A is an illustrative control flow diagram representing a configuration of the analysis and control block 405 of FIG. 10B to produce and analyze time-frequency transforms with different time-frequency resolutions in order to determine window sizes and time-frequency resolutions for audio signal frames of a received audio signal. FIG. 11B is an illustrative drawing representing a sequence of audio signal frames 1180 that includes an encoding frame 1182, an analysis frame 1021, a received frame 1186 and intermediate frames 1188. In some embodiments, the analysis and control block 405 in FIG. 4 may be configured to control audio frame processing according to the flow of FIG. 1*l* A.

Operation 1101 receives a received frame 1186. Operation 1103 buffers the received frame 1186. The framing block 403 may buffer a set of frames that includes the encoding frame 1182, the analysis frame 1021, the received frame 1186, and any intermediate buffered frames 1188 received in a sequence between receipt of the encoding frame 1084 and receipt of the received frame 1186. Although the example in FIG. 11B shows multiple intermediate frames 1188, there may be zero or more intermediate buffered frames 1188. During processing by the coder 400, an audio signal frame may transition from being a received frame to being an analysis frame to being an encoding frame. In other words, a received frame is queued for analysis and encoding. In some typical embodiments (not shown), the analysis frame 1021 is the same as and coincides with the received frame 1186. In some embodiments, the analysis frame 1021 may immediately follow the encoding frame 1182 with no intermediate buffered frames 1188. Moreover, in some embodiments, the encoding frame 1182, analysis frame 1021, and received frame 1186 all may be the same frame.

Operation 1105 employs the multiple time-frequency transform analysis blocks 1023, 1025, 1027 and 1029 to compute multiple different time-frequency transforms (having different time-frequency resolutions) of the analysis frame 1021 as explained above, for example. In some embodiments, the operation of a time-frequency transform block such as 1023, 1025, 1027, or 1029 may comprise applying a sequence of windows and correspondingly sized MDCTs across the analysis frame 1021, where the size of the windows in the sequence of windows may be chosen from a predetermined set of window sizes. Each of the time-frequency transform blocks may have a different corresponding window size chosen from the predetermined set of window sizes. The predetermined set of window sizes may for example correspond to short windows, intermediate windows, and long windows. In other embodiments, alternate transforms may be computed in transform blocks 1023-1029 whose time-frequency resolutions correspond to these various windowed MDCTs.

Operation 1107 may configure the analysis block 1043 of FIG. 10B to use one or more trellis algorithms to analyze the transform data for the analysis frame 1021 and potentially also that of buffered frames, such as intermediate frames 1188 and encoding frame 1182. The analysis in operation 1107 may employ the time-frequency transform analysis blocks 1023-1029 and the frequency band grouping blocks 1033-1039 to group the transform data for the analysis frame 1021 into frequency bands. In some embodiments, an across-frequency trellis algorithm may only operate on the transform data of a single frame, the analysis frame 1021. In some embodiments, an across-time algorithm may operate on the transform data of the analysis frame 1021 and a sequence of preceding buffered frames 1088 that may include the encoding frame 1182 and that also may include an additional one or more buffered frames 1088. In some embodiments of the across-time algorithm, operation 1107 may comprise operation of distinct trellis algorithms for each of one or more frequency bands. Operation 1107 thus may comprise operation of one or more trellis algorithms; operation 1107 may also comprise computation of costs for transition sequences through the one or more trellis structure paths. Operation 1109 may determine an optimal transition sequence for each of the one or more trellis algorithms based upon trellis path costs. Operation 1109 may further determine a time-frequency tiling corresponding to the optimal transition sequence determined for each of the one or more trellis algorithms. Operation 1111 may determine the optimal window size for the encoding frame 1182 based on a determined optimal path of the trellis; in some embodiments (of the across-frequency algorithm), the analysis frame 1021 and the encoding frame 1182 may be the same, meaning that the trellis algorithm operates directly on the encoding frame.

Operation 1113 communicates the window size to the windowing block 407 and the bitstream 413. Operation 1115 determines the optimal local transformations based on the window size choice and the optimal trellis path. Operation 1117 communicates the transform size and the optimal local transformations for the encoding frame 1182 to the transform block 409 and the bitstream 413.

Thus, it will be appreciated that an analysis frame 1021 is a frame on which analysis is currently being performed. A received frame 1186 is queued for analysis and encoding. An encoding frame is a frame 1182 on which encoding currently is being performed that may have been received before the current analysis frame. In some embodiments, there may be one or more additional intermediate buffered frames 1188.

In operation 1105, one or more sets of time-frequency tile frame transform coefficients are computed and grouped into frequency bands by blocks 1023-1029 and 1033, 1035, 1037, 1039 of the control block 405 of FIG. 10B for the analysis frame. In some embodiments, the time-frequency tile frame transform coefficients may be MDCT transform coefficients. In some embodiments, alternate time-frequency transforms such as a Haar or Walsh-Hadamard transform may be used. Multiple time-frequency tile frame transform coefficients corresponding to different time-frequency resolutions may be evaluated for a frame in block 405, for example in blocks 1023-1029.

The determined optimal transformation may be provided by the control module 405 to the processing path that includes blocks 407 and 409. Transforms such as a Walsh-Hadamard transform or a Haar transform determined by control block 405 may be used according to modification block 1007 by the transform block 409 of FIG. 10A for processing the encoding frame. Thus, for each window size, multiple different sets of time-frequency transform coefficients of the corresponding window segments which span the analysis frame may be computed. In some embodiments, application of windows extending beyond the analysis frame boundaries may be required to compute the time-frequency transform coefficients of windowed segments.

In operation 1107, the time-frequency resolution tile frame data generated in operation 1105 is analyzed in some embodiments, using cost functions associated with a trellis algorithm to determine the efficiency of each possible time-frequency resolution for coding the analysis frame. In some embodiments, operation 1107 corresponds to computing cost functions associated with a trellis structure. A cost function computed for a path through a trellis structure may indicate the coding effectiveness of the path (i.e. the coding cost, such as a metric that encapsulates how many bits would be needed to encode that representation). In some embodiments, the analysis may be carried out in conjunction with transform data from previous audio signal frames. In operation 1109, an optimal set of time-frequency tile resolutions for an encoding frame is determined based upon results of the analysis in operation 1107. In other words, in some embodiments, in operation 1109, an optimal path through the trellis structure is identified. All path costs are evaluated and a path with the optimal cost is selected. An optimal time-frequency tiling of a current encoding frame may be determined based upon an optimal path identified by the trellis analysis. In some embodiments, an optimal time-frequency tiling for a signal frame may be characterized by a higher degree of sparsity of the coefficients in the time-frequency representation of the signal frame than for any other potential tiling of that frame considered in the analysis process. In some embodiments, the optimality of a time-frequency tiling for a signal frame may be based in part on the cost of encoding the corresponding time-frequency representation of the frame. In some embodiments, an optimal tiling for a given signal may yield improved coding efficiency with respect to a suboptimal tiling, meaning that the signal may be encoded with the optimal tiling at a lower data rate but the same error or artifact level as a suboptimal tiling or that the signal may be encoded with the optimal tiling at a lower error or artifact level but the same data rate as with a suboptimal tiling. Those of ordinary skill in the art will understand that the relative performance of encoders may be assessed using rate-distortion considerations.

In some embodiments, the encoding frame 1182 may be the same frame as the analysis frame 1021. In other embodiments, the encoding frame 1182 may precede the analysis frame 1021 in time. In some embodiments, the encoding frame 1182 may immediately precede the analysis frame 1021 in time with no intermediate buffered frames 1188. In some embodiments, the analysis and control block 405 may process multiple frames to determine the results for the encoding frame 1182; for example, the analysis may process one or more of the frames, some of which may precede the encoding frame 1182 in time, such as the encoding frame 1182, buffer frames 1088 (if any) between the encoding frame 1182 and the analysis frame 1021, and the analysis frame 1021. For example, if the encoding frame 1182 is before the analysis frame in time, then analysis and control block 405 can use the "future" information to process an analysis frame 1021 currently being analyzed to make final decisions for the encoding frame. This "lookahead" ability helps improve the decisions made for the encoding frame. For example, better encoding may be achieved for an encoding frame 1182 because of new information that the trellis navigation may incorporate from an analysis frame 1021. In general, lookahead benefits apply to encoding decisions made across multiple frames such as those illustrated in FIGS. 14A-14E, discussed below. In some embodiments, the analysis may process buffer frames 1088 (if any) between the analysis frame 1021 and the received frame 1186 as well as the received frame. In some embodiments, the capability to process frames received before receipt of the encoding frame may be referred to as lookahead, for instance when the analysis frame corresponds to a time after the encoding frame.

In operation 1111, the analysis and control block 405 determines an optimal window size for the encoding frame 1182 at least in part based on the optimal time-frequency tile frame transform determined for the frame in operation 1109. The optimal path (or paths) for the encoding frame may indicate the best window size to use for the encoding frame 1182. The window size may be determined based on the path nodes of the optimal path through the trellis structure. For example, in some embodiments, the window size may be selected as the mean of the window sizes indicated by the path nodes of the optimal path through the trellis for the frame. In operation 1113, the analysis and control block 405 sends one or more signals to the windowing block 407, the transform block 409 and the data reduction and bitstream formatting block 411, to indicate the determined optimal window size. The data reduction and bitstream formatting block 411 encodes the window size into the bitstream for use by a decoder (not shown), for example. In operation 1115, optimal local time-frequency transformations for the encoding frame are determined at least in part based on the optimal time-frequency tile frame for the frame determined in step 1109. The optimal local time-frequency transforms also may be determined in part based on the optimal window size determined for the frame. More particularly, in accordance with some embodiments for example, in each frequency band, a difference is determined between the optimal time-frequency resolution for the band (indicated by the optimal trellis path) and the resolution provided by the window choice. That difference determines a local time-frequency transformation for that band in that frame. It will be appreciated that a single window size ordinarily must be selected to perform a time-frequency transform of an encoding frame 1182. The window size may be selected to provide a best overall match to the different time-frequency resolutions determined for the different frequency bands within the encoding frame 1182 based upon the trellis analysis. However, the selected window may not be an optimal match to time-frequency resolutions determined based upon the trellis analysis for one or more frequency bands. Such a window mismatch may result in inefficient coding or distortion of information within certain frequency bands. The local transformations according to the process of FIG. 9, for example, may aim to improve the coding efficiency and/or correct for that distortion within the local frequency bands.

In operation 1117, the optimal set of time-frequency transformations are provided to the transform block 409 and the data reduction and bitstream formatting block 411, which encodes the set of time-frequency transformations in the bitstream 413 so that a decoder can carry out the local inverse transformations.

In some embodiments, the time-frequency transformations may be encoded differentially with respect to transformations in adjacent frequency bands. In some embodiments, the actual transformation used (the matrix that is applied to the frequency band data) may be indicated in the bitstream. Each transformation may be indicated using an index into a set of possible transformations. The indices may then be encoded differentially instead of based upon their actual values. In some embodiments, the time-frequency transformations may be encoded differentially with respect to transformations in adjacent frames. In some embodiments, the data reduction and bitstream formatting block 411 may, for each frame, encode the base window size, the time-frequency resolutions for each band of the frame, and the transform coefficients for the frame into the bitstream for use by a decoder (not shown), for example. In some embodiments, one or more of the base window size, the time-frequency resolutions for each band, and the transform coefficients may be encoded differentially.

As discussed with reference to FIG. 11A, in some embodiments the analysis and control block 405 derives a window size and a local set of time-frequency transformations for each frame. Block 409 carries out the transformations on the audio signal frames. In the following, example embodiments are described for deriving an optimal window size and optimal sets of time-frequency transformations for a frame based on dynamic programming are disclosed. In some embodiments, all possible combinations of the multiplicity of time-frequency resolutions may be evaluated independently for all bands and all frames in order to determine the optimal combination based on a determined criterion or cost function. This may be referred to as a brute-force approach. As will be understood by those of ordinary skill in the art, the full set of possible combinations may be evaluated more efficiently than in a brute-force approach using an algorithm such as dynamic programming, which is described in further detail in the following.

FIG. 11C1-11C4 are illustrative functional block diagrams representing a sequence of frames flowing through a pipeline 1150 within the analysis block 405 and illustrating use of analysis results, produced during the flow, by the windowing block 407, transform block 409 and data reduction and bitstream formatting block 411 of the encoder 400 of FIG. 4. The analysis block 1043 of FIG. 10B includes the pipeline circuit 1150, which includes an analysis frame storage stage 1152, a second buffered frame storage stage 1154, a first buffered frame storage stage 1156 and an encoding frame storage stage 1158. The analysis frame storage stage may store, for example, frequency-band grouped transform results computed for analysis frame 1021 by transform blocks 1023-1029 and frequency band grouping blocks 1033-1039. The analysis frame data stored in the analysis frame storage stage may be moved through the storage stages of pipeline 1150 as new frames are received and analyzed. In some embodiments, an optimal time-frequency resolution for coding of an encoding frame within the encoding frame storage 1158 is determined based upon an optimal combination of time-frequency resolutions associated with frequency bands of the frames currently within the pipeline 1150. In some embodiments, the optimal combination is determined using a trellis process, described below, which determines an optimal path among time-frequency resolutions associated with frequency bands of the frames currently within the pipeline 1150. The analysis block 1043 of the analysis and control block 405 determine coding information 1160 for a current encoding frame based upon the determined optimal path. The coding information 1160 includes first control information $C_{407}$ provided to the windowing block 407 to determine a window size for windowing the encoding frame; second control information $C_{1003}$ provided to the time-frequency transform block 1003 to determine a transform size (e.g., MDCT) that matches the determined window size; third control information $C_{1005}$ provided to the frequency band grouping block 1005 to determine grouping of signal transform components (e.g., MDCT coefficients) to frequency bands; fourth control information $C_{1007}$ provided to the time-frequency resolution modification block 1007; and fifth control information $C_{411}$ provided to the data reduction and bitstream formatting block 411. The encoder 400 uses the coding information 1160 produced by the analysis and control block 405 to encode the current encoding frame.

Referring to FIG. 11C1, at a first time interval analysis data for a current analysis frame F4 is stored at the analysis frame storage stage 1152, analysis data for a current second buffered frame F3 is stored at the second buffered frame storage stage 1154, analysis data for a current first buffered frame F2 is stored at the first buffered frame storage stage 1156; and analysis data for a current encoding frame F1 is stored at the encoding frame storage stage 1158. As explained in detail below, in some embodiments, the analysis block 1043 is configured to perform a trellis process to determine an optimal combination of time-frequency resolutions for multiple frequency bands of the current encoding frame F1. In some embodiments, the analysis block 1043 is configured to select a single window size for use by the windowing block 407 in production of an encoded frame $F_{1C}$ corresponding to the current encoding frame F1 in the analysis pipeline 1150. The analysis block produces the first, second and third control signals $C_{407}$, $C_{1003}$ and $C_{1005}$ based upon the selected window size. The selected window size may not match an optimal time-frequency transformation determined for one or more frequency bands within the current encoding frame F1. Accordingly, in some embodiments, the analysis block 1043 produces the fourth time-frequency modification signal $C_{1007}$ for use by the time-frequency transformation modification block 1007 to modify time-frequency resolutions within frequency bands of the current encoding frame F1 for which the optimal time-frequency resolutions determined by the analysis block 1042 are not matched to the selected window size. The analysis block 1043 produces the fifth control signal $C_{411}$ for use by the data reduction and bitstream formatting block 411 to inform the decoder 1600 of the determined encoding of the current encoding frame, which may include an indication of the time-frequency resolutions used in the frequency bands of the frame.

During each time interval, an optimal time-frequency resolution for a current encoding frame and coding information for use by the decoder 1600 to decode the corresponding time-frequency representation of the encoding frame are produced based upon frames currently contained within the pipeline. More particularly, referring to FIGS. 11C1-11C4, at successive time intervals, analysis data for a new current analysis frame shifts into the pipeline 1150 and the analysis data for the previous frames shift (left), such that the analysis data for a previous encoding frame shifts out. Referring to FIG. 11C, at a first time interval, F4 is the current analysis frame; F3 is the current second buffered frame, F2 is the current first buffered frame; and F1 is the current encoding frame. Thus, at the first time interval, analysis data for frames F4-F1 are used to determine time-frequency resolutions for different frequency bands within the current encoding frame F1 and to determine a window size and time-frequency transformation modifications to use for encoding the current encoding frame F1 at the determined time-frequency resolutions. Control signals 1160 are produced corresponding to the current encoding frame F1. The current encoded frame $F_{1C}$ is produced using the coding signals. The encoding frame version $F_{1C}$ may be quantized (compressed) for transmission or storage and corresponding fifth control signals $C_{411}$ may be provided for use to decode the quantized encoding frame version $F_{1C}$.

Referring to FIG. 11C2, F5 is the current analysis frame, F4 is the current second buffered frame, F3 is the current first buffered frame, F2 is the current encoding frame, and control signals 1160 are produced that are used to generate an current encoding frame version $F_2$c. Referring to FIG. 11C3, F6 is the current analysis frame, F5 is the current second buffered frame, F4 is the current first buffered frame, F3 is the current encoding frame, and control signals 1160 are produced that are used to generate a current encoding frame version $F_{3C}$. Referring to FIG. 11C4, F7 is the current analysis frame, F6 is the current second buffered frame, F5 is the current first buffered frame, F4 is the current encoding frame, and control signals 1160 are produced that are used to generate a current encoding frame version Fac.

It will be appreciated that the encoder 400 may produce a sequence of encoding frame versions ($F_{1C}$, $F_{2C}$, $F_{3C}$, $F_{4C}$) based upon corresponding sequence of current encoding frames (F1, F2, F3, F4). The encoding frame versions are invertible based at least in part upon frame size information and time-frequency modification information, for example. In particular, for example, a window may be selected to produce an encoding frame that does not match the optimal determined time-frequency resolution within one or more frequency bands within the current encoding frame in the pipeline 1150. The analysis block may determine time-frequency resolution modification transformations for the one or more mismatched frequency bands. The modification signal information $C_{1007}$ may be used to communicate the selected adjustment transformation such that appropriate inverse modification transformations may be carried out in the decoder according to the process described above with reference to FIG. 9.

Figure 12:
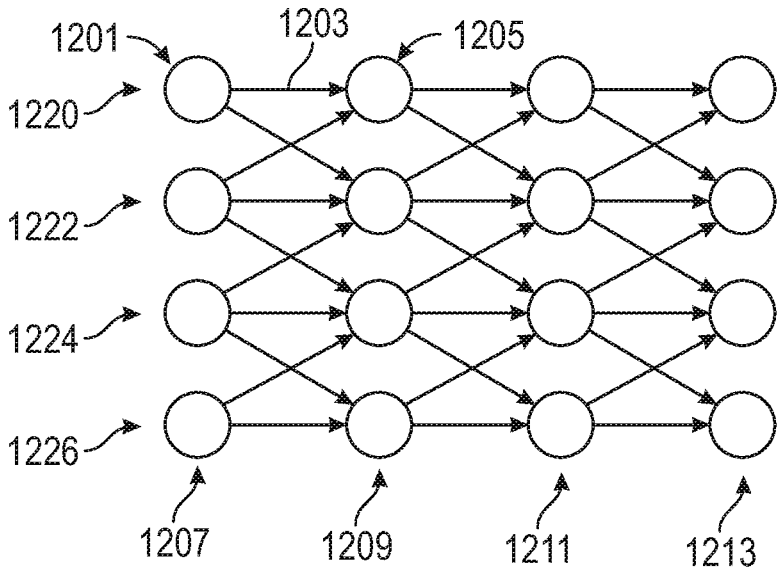
FIG. 12 is an illustrative drawing representing an example trellis structure used by the analysis and control block of FIG. 10B to optimize time-frequency resolutions across multiple frequency bands.

Trellis Processing to Determine Optimal Time-Frequency Resolutions for Multiple Frequency Bands FIG. 12 is an illustrative drawing representing an example trellis structure that may be implemented using the analysis block 1043 for a trellis-based optimization process. The trellis structure includes a plurality of nodes such as example nodes 1201 and 1205 and includes transition paths between nodes such as transition path 1203. In typical cases, the nodes may be organized in columns such as example columns 1207, 1209, 1211, and 1213. Though only some transition paths are depicted in FIG. 12, in typical cases transitions may occur between any two nodes in adjacent columns in the trellis. A trellis structure may be used to perform an optimization process to identify an optimal transition sequence of transition paths and nodes to traverse the trellis structure, based upon costs associated with the nodes and costs associated with the transitions paths between nodes, for example. For example, a transition sequence through the trellis in FIG. 12 may include one node from column 1207, one node from column 1209, one node from column 1211, and one node from column 1213 as well as transition paths between the respective nodes in adjacent columns. A node may have a state associated with it, where the state may consist of a multiplicity of values. The cost associated with a node may be referred to as a state cost, and the cost associated with a transition path between nodes may be referred to as a transition cost. To determine an optimal transition sequence (sometimes referred to as an optimal 'state sequence' or an optimal 'path sequence'), a brute force approach may be used wherein a global cost of every possible transition sequence is independently assessed and the transition sequence with the optimal cost is then determined by the comparing the global costs of all of the possible paths. As will be understood by those of ordinary skill in the art, the optimization may be more efficiently carried out using dynamic programming, which may determine the transition sequence having optimal cost with less computation than a brute-force approach. As will be understood by those of ordinary skill in the art, the trellis structure of FIG. 12 is an illustrative example and in some cases a trellis diagram may include more or fewer columns than the example trellis structure depicted in FIG. 12 and in some cases the columns in the trellis may comprise more or fewer nodes than the columns in the example trellis structure of FIG. 12. It will be appreciated that the terms column and row are used for convenience and that the example trellis structure comprises a grid structure in which either perpendicular orientation may be labeled as column or as row.

Figure 13A:
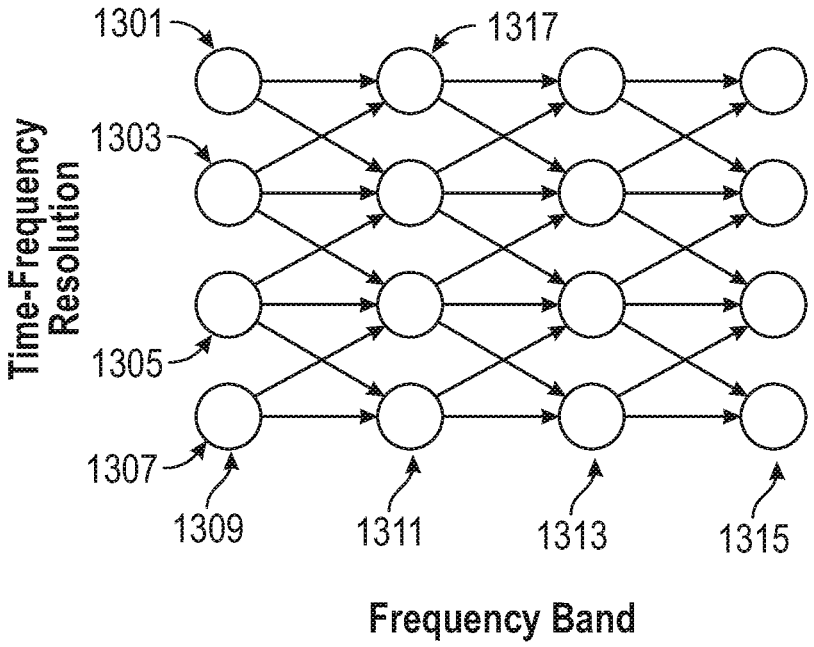
FIG. 13A is an illustrative drawing representing a trellis structure used by the analysis and control block of FIG. 10B, configured to partition a frequency spectrum into frequency bands and to provide four time-frequency resolution options to guide a dynamic trellis-based optimization process.

In some embodiments, analysis and control block 405 may determine an optimal window size and a set of optimal time-frequency resolution transformations for an encoding frame of an audio signal using a trellis structure configured as in FIG. 13A to guide a dynamic trellis-based optimization process. The columns of the trellis structure may correspond to the frequency bands into which a frequency spectrum is partitioned. In some embodiments, column 1309 may correspond to a lowest frequency band and columns 1311, 1313, and 1315 may correspond to progressively higher frequency bands. In some embodiments, (e.g., FIGS. 13A-13B2) row 1307 may correspond to a highest frequency resolution and rows 1305, 1303, and 1301 may correspond to progressively lower frequency resolution and progressively higher time resolution. In some embodiments, rows 1301-1307 in the trellis structure may relate to windows of different sizes (and corresponding transforms) applied to the analysis frame 1021 by transform blocks 1023-1029 in analysis and control block 405.

FIG. 13A is an illustrative drawing representing the analysis block 1043 configured to implement a trellis structure configured to partition the spectrum into four frequency bands and to provide four time-frequency resolution options within each frequency band to guide a dynamic trellis-based optimization process. Those of ordinary skill in the art will understand that the trellis structure of FIG. 13A may be configured to direct a dynamic trellis-based optimization process to use a different number of frequency bands or a different number of resolution options.

In some embodiments, a node in the trellis structure of FIG. 13A may correspond to a frequency band and to a time-frequency resolution within the band in accordance with the column and row of the node's location in the trellis structure. For some embodiments incorporating the trellis structure of FIG. 13A, the analysis frame may immediately follow the encoding frame in time. For some embodiments incorporating the trellis structure of FIG. 13A, the analysis frame and the encoding frame may be the same frame. In other words, the analysis block 1043 may be configured to implement a pipeline 1150 of length one.

Referring to FIG. 10C and FIG. 13A, nodes 1301-1307 within the first, left-most, column of the trellis (column 1309) may correspond to coefficients sets $\{C_{T\text{-}F1}\}_1$, $\{C_{T\text{-}F2}\}_1$, $\{C_{T\text{-}F3}\}_1$ and $\{C_{T\text{-}F4}\}$ within FB1 in FIG. 10C. Nodes within the second column of the trellis (column 1311) may correspond to coefficients sets $\{C_{T\text{-}F1}\}_2$, $\{C_{T\text{-}F2}\}_2$, $\{C_{T\text{-}F3}\}_2$ and $\{C_{T\text{-}F4}\}_2$ within FB2 in FIG. 10C. Nodes within the third column of the trellis (column 1313) may correspond to coefficients sets $\{C_{T\text{-}F1}\}_3$, $\{C_{T\text{-}F2}\}_3$, $\{C_{T\text{-}F3}\}_3$ and $\{C_{T\text{-}4}\}_3$ within FB3 in FIG. 10C. Nodes within the fourth column of the trellis (column 1315) may correspond to coefficients sets $\{C_{T\text{-}F1}\}_4$, $\{C_{T\text{-}F2}\}_4$, $\{C_{T\text{-}F3}\}_4$ and $\{C_{T\text{-}F4}\}_4$ within FB4 in FIG. 10C. In some embodiments, each column of the trellis 13A may correspond to a different frequency band.

Thus, in some embodiments, a node may be associated with a state that includes transform coefficients corresponding to the node's frequency band and time-frequency resolution. For example, in some embodiments node 1317 may be associated with a second frequency band (in accordance with column 1311) and a lowest frequency resolution (in accordance with row 1301). In some embodiments, the transform coefficients may correspond to MDCT coefficients corresponding to the node's associated frequency band and resolution. MDCT coefficients may be computed for each analysis frame for each of a set of possible window sizes and corresponding MDCT transform sizes. In some embodiments, the MDCT coefficients may be produced according to the transform process of FIG. 9 wherein MDCT coefficients are computed for an analysis frame for a prescribed window size and MDCT transform size and wherein different sets of transform coefficients may be produced for each frequency band based upon different time-resolution transforms imparted on the MDCT coefficients in the respective frequency bands via local Haar transformations or via local Walsh-Hadamard transformations, for example. In some embodiments, the transform coefficients may correspond to approximations of MDCT coefficients for the associated frequency band and resolution, for example Walsh-Hadamard transform coefficients or Haar transform coefficients. In some embodiments, a state cost of a node may comprise in part a metric related to the data required for encoding the transform coefficients of the node state. In some embodiments, a state cost may be a function of a measure of the sparsity of the transform coefficients of the node state.

In some embodiments, a state cost of a node state in terms of transform coefficient sparsity may be a function in part of the 1-norm of the transform coefficients of the node state. In some embodiments, a state cost of a node state in terms of transform coefficient sparsity may be a function in part of the number of transform coefficients having a significant absolute value, for instance an absolute value above a certain threshold. In some embodiments, a state cost of a node state in terms of transform coefficient sparsity may be a function in part of the entropy of the transform coefficients. It will be appreciated that in general, the more sparse the transform coefficients corresponding to the time-frequency resolution associated with a node, the lower the cost associated with the node. In some embodiments, a transition path cost associated with a transition path between nodes may be a measure of the data cost for encoding a change between the time-frequency resolutions associated with the nodes connected by the transition path. More specifically, in some embodiments, a transition path cost may be a function in part of the time-frequency resolution difference between the nodes connected by the transition path. For example, a transition path cost may be a function in part of the data required for encoding the difference between integer values corresponding to the time-frequency resolution of the states of the connected nodes. Those of ordinary skill in the art will understand that the trellis structure may be configured to direct a dynamic trellis-based optimization process to use other cost functions than those disclosed.

FIG. 13B1 is an illustrative drawing representing an example first optimal transition sequence across frequency through the trellis structure of FIG. 13A for an example audio signal frame. As will be understood by those of ordinary skill in the art, a transition sequence through a trellis structure may be alternatively referred to as a path through the trellis. FIG. 13B2 is an illustrative first time-frequency tile frame corresponding to the first transition sequence across frequency of FIG. 13B1 for the example audio signal frame. The example first optimal transition sequence is indicated by the 'x' marks in the nodes in the trellis structure. In accordance with embodiments described above with reference to FIG. 13A, the indicated first optimal transition sequence may correspond to a highest frequency resolution for the lowest frequency band, a lower frequency resolution for the second and third frequency bands, and a highest frequency resolution for the fourth band. The time-frequency tile frame of FIG. 13B2 includes highest frequency resolution tiles 1353 for the lowest band 1323, lower frequency resolution tiles 1355, 1357 for the second and third bands 1325, 1327, and highest frequency resolution tiles 1359 for the fourth band 1329. In the FIG. 13B2, the time-frequency tile frame 1321, the frequency band partitions are demarcated by the heavier horizontal lines.

It will be appreciated that for the example trellis processing of FIG. 13B1 and FIG. 13C1, since there is no trellis processing across time in the trellis, there is no need or benefit from extra lookahead. The trellis analysis is run on an analysis frame, which in some embodiments may be the same frame in time as the encoding frame. In other embodiments, the analysis frame may be the next frame in time after the encoding frame. In other embodiments, there may be one or more buffered frames between the analysis frame and the encoding frame. The trellis analysis for the analysis frame may indicate how to complete the windowing of the encoding frame prior to transformation. In some embodiments it may indicate what window shape to use to conclude windowing the encoding frame in preparation for transforming the encoding frame and in preparation for a subsequent processing cycle wherein the present analysis frame becomes the new encoding frame.

FIG. 13C1 is an illustrative drawing representing an example second optimal transition sequence across frequency through the trellis structure of FIG. 13A for another example audio signal frame. FIG. 13C2 is an illustrative second time-frequency tile frame corresponding to the second transition sequence across frequency of FIG. 13C1. The example second optimal transition sequence is indicated by the 'x' marks in the nodes in the trellis structure. In accordance with embodiments described above with reference to FIG. 13A, the indicated second optimal transition sequence may correspond to a highest frequency resolution for the lowest frequency band, a lower frequency resolution for the second band, a progressively lower frequency resolution for the third frequency band, and a progressively higher frequency resolution for the fourth band. The time-frequency tile frame of FIG. 13C2 includes highest frequency resolution tiles 1363 for the lowest band 1343, identical lower frequency resolution tiles 1365, 1369 for the second and fourth bands band 1345, 1349 and even lower frequency resolution tiles 1367 for the third band 1347.

In some embodiments, analysis and control block 405 is configured to use the trellis structure of FIG. 13A to direct a dynamic trellis-based optimization process to determine a window size and time-frequency transform coefficients for an audio signal frame based upon an optimal transition sequence through the trellis structure. For example, a window size may be determined based in part on an average of the time-frequency resolutions corresponding to the determined optimal transition sequence through the trellis structure. In FIGS. 13C1-C2 for example, the window size for the audio data frame may be determined to be the size corresponding to the time-frequency tiles of the bands 1345 and 1349. This may be an intermediate-sized window half the size of a long window, for example, such as the size of each of the two windows depicted for frame 806 of FIG. 8. Time-frequency transform coefficient modifications may be determined based in part on the difference between the time-frequency resolutions corresponding to the determined optimal transition sequence and the time-frequency resolution corresponding to the determined window. The control block 405 may be configured to implement a transition sequence enumeration process as part of a search for an optimal transition sequence to determine optimal time-frequency modifications. In some embodiments, the enumeration may be used as part of an assessment of the path cost. In other embodiments, the enumeration may be used as a definition of the path and not be part of the cost function. It may be that it would take more bits to encode certain path enumerations than others, so some paths might have a cost penalty due to the transitions. For example, second optimal transition sequence shown in FIG. 13C1 may be enumerated as +1 for band 1341, 0 for band 1345, −1 for band 1347, and 0 for band 1349, where, for example, +1 may indicate a specific increase in frequency resolution (and a decrease in time resolution), 0 may indicate no change in resolution, and −1 may indicate a specific decrease in frequency resolution (and an increase in time resolution).

In some embodiments, the analysis and control block 405 may be configured to use additional enumerations; for example, a +2 may indicate a specific increase in frequency resolution greater than that enumerated by +1. In some embodiments, an enumeration of a time-frequency resolution change may correspond to the number of rows in the trellis spanned by the corresponding transition path of an optimal transition sequence. In some embodiments, the control block 405 may be configured to use enumerations to control the transform modification block 1009. In some embodiments, the enumeration may be encoded into the bitstream 413 by the data reduction and bitstream formatting block 411 for use by a decoder (not shown).

Figure 14A:
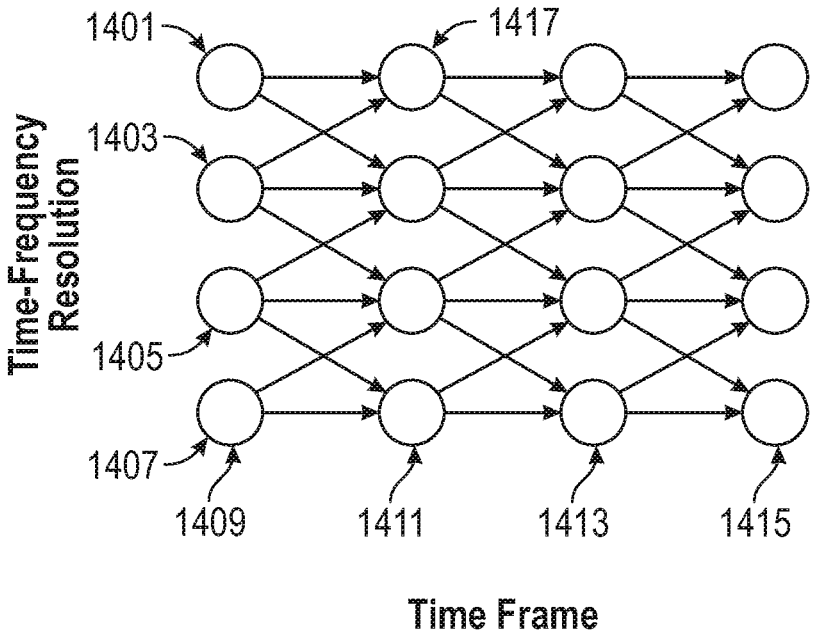
FIG. 14A is an illustrative drawing representing a trellis structure used by the analysis block of FIG. 10B, configured to partition a signal into frames and to provide four time-frequency resolution options to guide a dynamic trellis-based optimization process.

In some embodiments, the analysis block 1043 of the analysis and control block 405 may be configured to determine an optimal window size and a set of optimal time-frequency resolution modification transformations for an audio signal using a trellis structure configured as in FIG. 14A to guide a dynamic trellis-based optimization process for each of one or more frequency bands. A trellis may be configurated to operate for a given frequency band. In one embodiment, a trellis-based optimization process is carried out for each frequency band grouped in the frequency band grouping blocks 1033-1039. The columns of the trellis structure may correspond to audio signal frames. In one embodiment, column 1409 may correspond to a first frame and columns 1411, 1413, and 1415 may correspond to second, third and fourth frames. In one embodiment, row 1407 may correspond to a highest frequency resolution and rows 1405, 1403, and 1401 may correspond to progressively lower frequency resolution and progressively higher time resolution. The trellis structure of FIG. 14A is illustrative of an embodiment configured to operate over four frames and to provide four time-frequency resolution options for each frame. Those of ordinary skill in the art will understand that the trellis structure of FIG. 14A may be configured to direct a dynamic trellis-based optimization process to use a different number of frames or a different number of resolution options.

Figure 14B:
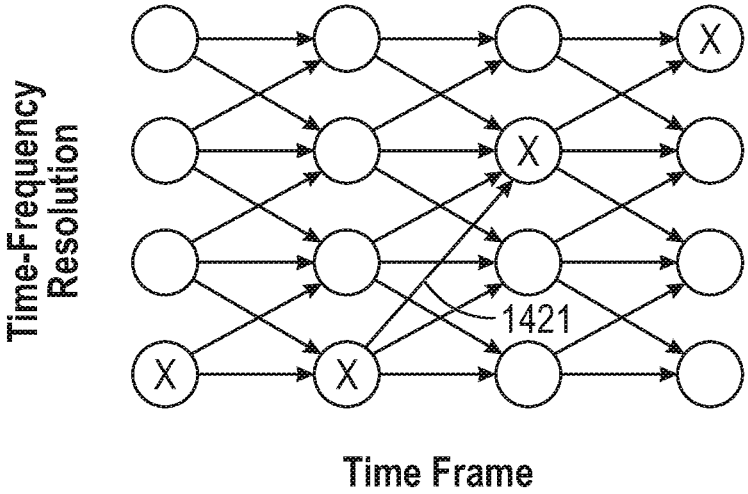
FIG. 14B is an illustrative drawing representing the example trellis structure of FIG. 14A for a sequence of four frames for an example first (lowest) frequency band with an example optimal first transition sequence across time indicated by the 'x' marks in the nodes in the trellis structure.
Figure 14C:
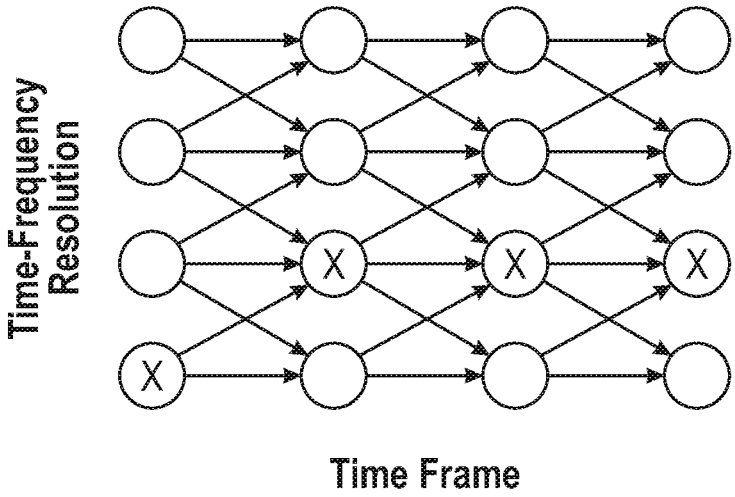
FIG. 14C is an illustrative drawing representing the example trellis structure of FIG. 14A for a sequence of four frames for an example second (next higher) frequency band with an example optimal second transition sequence across time indicated by the 'x' marks in the nodes in the trellis structure.
Figure 14D:
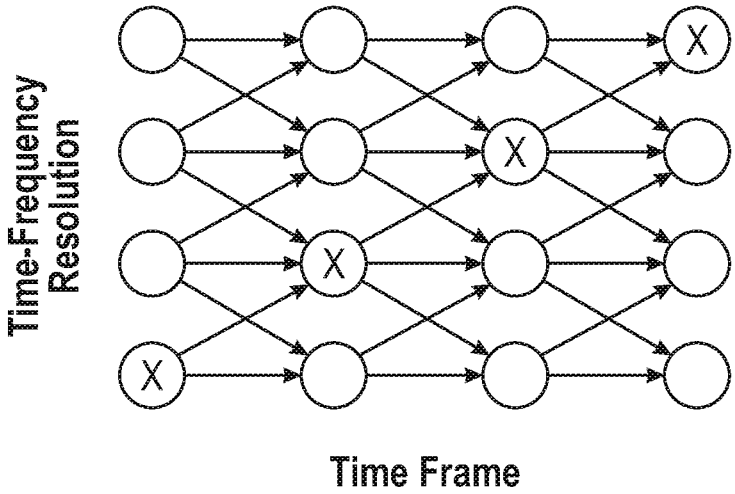
FIG. 14D is an illustrative drawing representing the example trellis structure of FIG. 14A for a sequence of four frames for an example third (next higher) frequency band with an example optimal third transition sequence across time indicated by the 'x' marks in the nodes in the trellis structure.
Figure 14E:
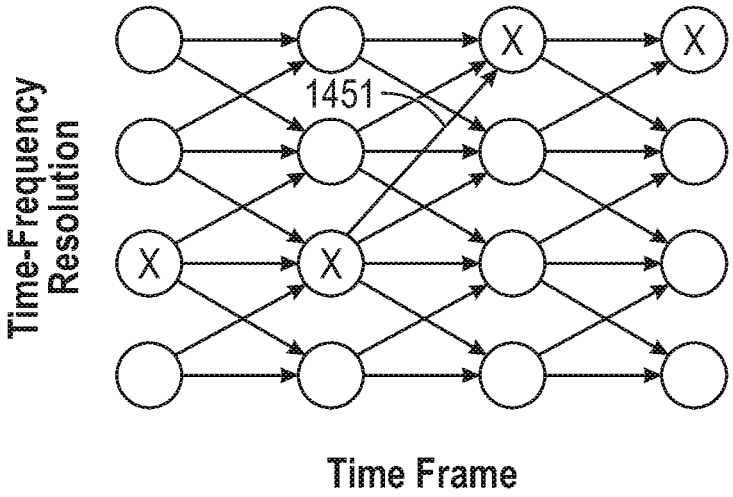
FIG. 14E is an illustrative drawing representing the example trellis structure of FIG. 14A for a sequence of four frames for an example fourth (highest higher) frequency band with an example optimal fourth transition sequence across time indicated by the 'x' marks in the nodes in the trellis structure.

In some embodiments the first frame may be an encoding frame, the second and third frames may be buffered frames and the fourth frame may be an analysis frame. Referring to FIG. 10C and FIG. 14B, the fourth column may correspond to a portion of an analysis frame, for example a frequency band FB1, and the bottom through top nodes of the fourth column may correspond to coefficients sets $\{C_{T\text{-}F1}\}_1$, $\{C_{T\text{-}F2}\}_1$, $\{C_{T\text{-}F3}\}_1$ and $\{C_{T\text{-}F4}\}_1$ within FB1 in FIG. 10C. Referring to FIG. 10C and FIG. 14C, the fourth column may correspond to a portion of an analysis frame, for example a frequency band FB2, and the bottom through top nodes of the fourth column may correspond to coefficients sets $\{C_{T\text{-}F1}\}_2$, $\{C_{T\text{-}F2}\}_2$, $\{C_{T\text{-}F3}\}_2$ and $\{C_{T\text{-}F4}\}_2$ within FB2 in FIG. 10C. Referring to FIG. 10C and FIG. 14D, the fourth column may correspond to a portion of an analysis frame, for example a frequency band FB3, and the bottom through top nodes of the fourth column may correspond to coefficients sets $\{C_{T\text{-}F1}\}_3$, $\{C_{T\text{-}F2}\}_3$, $\{C_{T\text{-}F3}\}_3$ and $\{C_{T\text{-}F4}\}_3$ within FB3 in FIG. 10C. Referring to FIG. 10C and FIG. 14E, the fourth column may correspond to a portion of an analysis frame, for example a frequency band FB4, and the bottom through top nodes of the fourth column may correspond to coefficients sets $\{C_{T\text{-}F1}\}_4$, $\{C_{T\text{-}F2}\}_4$, $\{C_{T\text{-}F3}\}_4$ and $\{C_{T\text{-}F4}\}_4$ within FB4 in FIG. 10C.

In some embodiments, a node in the trellis structure of FIG. 14A may correspond to a frame and a time-frequency resolution in accordance with the column and row of the node's location in the trellis structure. In one embodiment, a node may be associated with a state that includes transform coefficients corresponding to the node's frame and time-frequency resolution. For example, in one embodiment node 1417 may be associated with a second frame (in accordance with column 1411) and a lowest frequency resolution (in accordance with row 1401). In one embodiment, the transform coefficients may correspond to MDCT coefficients corresponding to the node's associated frequency band and resolution. In one embodiment, the transform coefficients may correspond to approximations of MDCT coefficients for the associated frequency band and resolution, for example Walsh-Hadamard or Haar coefficients. In one embodiment, a state cost of a node may comprise in part a metric related to the data required for encoding the transform coefficients of the node state. In some embodiments, a state cost may be a function of a measure of the sparsity of the transform coefficients of the node state.

In some embodiments, a state cost of a node state in terms of transform coefficient sparsity may be a function in part of the 1-norm of the transform coefficients of the node state. As explained above, in some embodiments, a state cost of a node state in terms of transform coefficient sparsity may be a function in part of the number of transform coefficients having a significant absolute value, for instance an absolute value above a certain threshold. In some embodiments, a state cost of a node state in terms of transform coefficient sparsity may be a function in part of the entropy of the transform coefficients. It will be appreciated that in general, the more sparse the transform coefficients corresponding to the time-frequency resolution associated with a node, the lower the cost associated with the node. Moreover, as explained above, in some embodiments, a transition cost associated with a transition path between nodes may be a measure of the data cost for encoding a change in the time-frequency resolutions associated with the nodes connected by the transition path. More specifically, in some embodiments, a transition path cost may be a function in part of the time-frequency resolution difference between the nodes connected by the transition path. For example, a transition path cost may be a function in part of the data required for encoding the difference between integer values corresponding to the time-frequency resolution of the states of the connected nodes. Those of ordinary skill in the art will understand that the trellis structure may be configured to direct a dynamic trellis-based optimization process to use other cost functions than those disclosed.

FIG. 14B is an illustrative drawing representing the example trellis structure of FIG. 14A with an example optimal first transition sequence across time indicated by the 'x' marks in the nodes in the trellis structure. In accordance with embodiments described above in relation to FIG. 14A, the indicated transition sequence may correspond to a highest frequency resolution for the first frame, a highest frequency resolution for the second frame, a lower frequency resolution for the third frame, and a lowest frequency resolution for the fourth frame. The optimal transition sequence indicated in FIG. 14B includes a transition path 1421, which represents a +2 enumeration, which was not depicted explicitly in FIG. 14A but which was understood to be a valid transition option omitted from FIG. 14A along with numerous other transition connections for the sake of simplicity. As an example, the trellis structure in FIG. 14B may correspond to four frames of a lowest frequency band depicted as band 1503 in the time-frequency tile frames 1501 in FIG. 15. The time-frequency tile frames 1501 depict a corresponding tiling with a lowest frequency band 1503 with a highest frequency resolution for the first frame 1503-1, a highest frequency resolution for the second frame 1503-2, a lower frequency resolution for the third frame 1503-3, and a lowest frequency resolution for the fourth frame 1503-4. In the tile frame 1501, frequency band partitions are indicated by the heavier horizontal lines.

FIG. 14C is an illustrative drawing representing the example trellis structure of FIG. 14A with an example optimal second transition sequence across time indicated by the 'x' marks in the nodes in the trellis structure. In accordance with embodiments described above in relation to FIG. 14A, the indicated transition sequence may correspond to a highest frequency resolution for the first frame, a lower frequency resolution for the second frame, a lower frequency resolution for the third frame, and a lower frequency resolution for the fourth frame. As an example, the trellis diagram in FIG. 14C may correspond to four frames of a second frequency band depicted as band 1505 in the time-frequency tile frames 1501 in FIG. 15. The time-frequency tile frames 1501 depict a corresponding tiling with a second frequency band 1505 with a highest frequency resolution for the first frame 1505-1, second, third and fourth frames 1505-2, 5105-3, 1505-4, each having an identical lower frequency resolution.

FIG. 14D is an illustrative drawing representing the example trellis structure of FIG. 14A with an example optimal third transition sequence across time indicated by the 'x' marks in the nodes in the trellis structure. In accordance with embodiments described above in relation to FIG. 14A, the indicated transition sequence may correspond to a highest frequency resolution for the first frame, a lower frequency resolution for the second frame, a progressively lower frequency resolution for the third frame, and a lowest frequency resolution for the fourth frame. As an example, the trellis diagram in FIG. 14D may correspond to four frames of a third frequency band depicted as band 1507 in the time-frequency tile frames 1501 in FIG. 15. The time-frequency tile frames 1501 depict a corresponding tiling with a third frequency band 1507 with a highest frequency resolution for the first frame 1507-1, a lower frequency resolution for the second frame 1507-2, a progressively lower frequency resolution for the third frame 1507-3, and a lowest frequency resolution for the fourth frame 1507-4.

FIG. 14E is an illustrative drawing representing the example trellis structure of FIG. 14A with an example optimal fourth transition sequence across time indicated by the 'x' marks in the nodes in the trellis structure. The optimal transition sequence indicated in FIG. 14E includes a transition 1451, which represents a +2 enumeration, which was not depicted explicitly in FIG. 14A but which was understood to be a valid transition option omitted from FIG. 14A along with numerous other transition connections for the sake of simplicity. As an example, the trellis diagram in FIG. 14E may correspond to four frames of a highest frequency band depicted as band 1509 in the time-frequency tiling 1501 in FIG. 15. The time-frequency tile frames 1501 depict a corresponding tiling with a highest frequency band 1509 with high frequency resolution for the first and second frames 1509-1, 1509-2 and a lowest frequency resolution for the third and fourth frames 1509-3, 1509-4.

Figure 15:
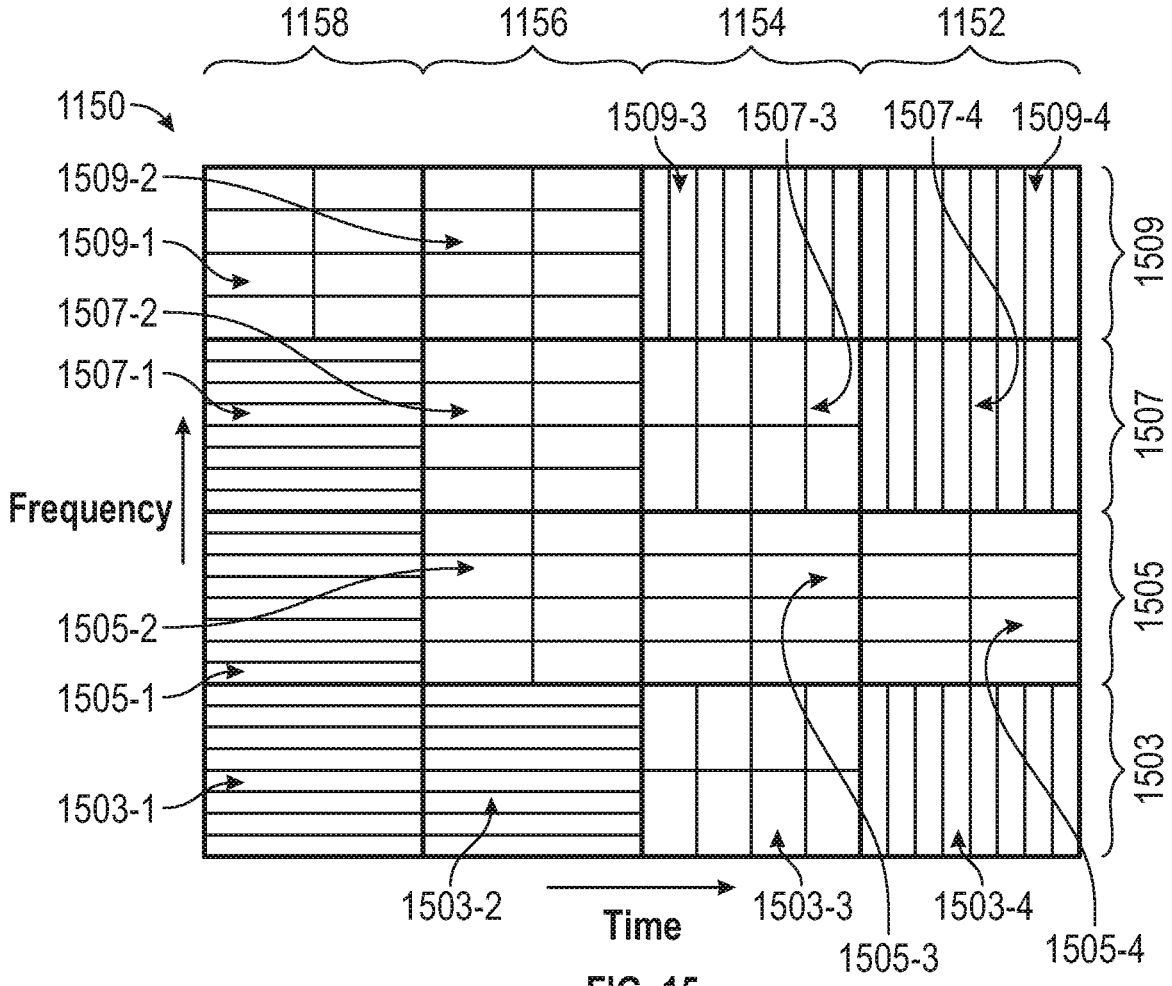
FIG. 15 is an illustrative drawing representing a sequence of four frames for four frequency bands corresponding to the dynamic trellis-based optimization process results depicted in FIGS. 14B, 14C, 14D, and 14E.

FIG. 15 is an illustrative drawing representing time-frequency frames corresponding to the dynamic trellis-based optimization process results depicted in FIGS. 14B, 14C, 14D, and 14E. FIG. 15 represents the pipeline 1150 of FIGS. 11C1-1C4 in which an analysis frame is contained within storage stage 1152, second and first buffered frames are contained within respective storage stages 1154, 1156, and encoding frame is contained within storage stage 1158. This arrangement matches up with the corresponding across-time trellises for each specific frequency band in FIGS. 14B-14E (as well as the template across-time trellis in FIG. 14A). Moreover, in FIG. 15, the tiling for the low frequency band 1503 corresponds to the dynamic trellis-based optimization result depicted in FIG. 14B. The tiling for the intermediate frequency band 1505 corresponds to the dynamic trellis-based optimization result depicted in FIG. 14C. The tiling for the intermediate frequency band 1507 corresponds to the dynamic trellis-based optimization result depicted in FIG. 14D. The tiling for the high frequency band 1509 corresponds to the dynamic trellis-based optimization result depicted in FIG. 14E.

Thus, for lookahead-based processing using a trellis decoder, for example, an optimal path may be computed up to the current analysis frame. Nodes on that optimal path from the past (e.g., three frames back) may then be used for the encoding. Referring to FIG. 14A, for example, trellis column 1409 may correspond to an 'encoding' frame; trellis columns 1411, 1413 may correspond to first and second 'buffered' frames; and trellis column 1415 may correspond to an 'analysis' frame. It will be appreciated that the frames are in in a pipeline such that in a next cycle when a next received frame arrives, what previously was the first buffered frame next becomes the encoding frame, what previously was the second buffered frame next becomes the first frame, what previously was the received frame next becomes the second buffered frame. Thus, lookahead in a "running" trellis operates by computing an optimal path up to a current received frame and then using the node on that optimal path from the past (e.g., three frames back) for the encoding. In general, the more frames there are between the 'encoding frame' and the 'analysis frame' (i.e. the longer the trellis in time), the more likely the result for the encoding frame will be a globally optimal result (meaning the result obtained if *all* of the future frames were included in the trellis). Multiple embodiments of a dynamic trellis-based optimization for determining an optimal time-frequency resolution for each frequency band in each frame have been described. In aggregate, the results of the dynamic trellis-based optimization provide an optimal time-frequency tiling for the signal being analyzed. In embodiments in accordance with FIG. 13A, an optimal time-frequency tiling for a frame may be determined by analyzing the frame with a dynamic program that operates across frequency bands. The analysis may be carried out one frame at a time and may not incorporate data from other frames. In embodiments in accordance with FIG. 14A, an optimal time-frequency tiling for a frame may be determined by analyzing each frequency band with a dynamic program that operates across multiple frames. The time-frequency tiling for a frame may then be determined by aggregating the results across bands for that frame. While the dynamic program in such embodiments may identify an optimal path spanning multiple frames, a result for a single frame of the path may be used for processing the encoding frame.

In embodiments in accordance with FIG. 13A or FIG. 14A, nodes of the described dynamic programs may be associated to states which correspond to transform coefficients at a particular time-frequency resolution for a particular frequency band in a particular frame. In embodiments in accordance with FIG. 13A or FIG. 14A, an optimal window size and local time-frequency transformations for a frame are determined from the optimal tiling. In some embodiments, the window size for a frame may be determined based on an aggregate of the optimal time-frequency resolutions determined for frequency bands in the frame. The aggregate may comprise at least in part a mean or a median of the time-frequency resolutions determined for the frequency bands. In some embodiments, the window size for a frame may be determined based on an aggregate of the optimal time-frequency resolutions across multiple frames. In some embodiments, the aggregate may depend on the cost functions used in the dynamic program operations.

Example of Modification of Signal Transform Time-Frequency Resolution within a Frequency Band of a Frame Due to Selection Of Mismatched Window Size Referring again to FIG. 15, an optimal time-frequency tiling determined by analysis block 1043 for a current encoding frame within the encoding storage stage 1158 of the pipeline 1150 consists of identical time-frequency resolutions for the lower three frequency bands 1503, 1505, 1507 and includes a time-frequency resolution for the highest frequency band 1509. In some embodiments, the analysis block 1043 may be configured to select a window size that matches the time-frequency resolutions of the three lower frequency bands of the encoding frame since such a window size may provide the best overall match to the time-frequency resolutions of the encoding frame (i.e. matches for three out of four frequency bands in this example). The analysis block 1043 provides first, second, and third control signals $C_{407}$ $C_{1003}$, $C_{1005}$ having values to cause the windowing block 407 to window the current encoding frame using the selected window size and to cause the transform and grouping blocks 1003, 1005 to transform the current encoding frame and to group resulting transform coefficients consistent with the selected window size so as to provide a frequency-band grouped time-frequency representation of the current encoding signal frame within the pipeline 1150. In this example, the analysis block 1043 also provides a fourth control signal $C_{1007}$ having a value to instruct the time-frequency resolution transformation modification block 1007 to adjust the time-frequency transform components of the highest frequency band 1509 of the encoding frame time-frequency representation that has been produced using blocks 407, 1003, 1005. It will be appreciated that in this example, the selected window size is not matched to the optimal time-frequency resolution determined for the highest frequency band 1509 of the current encoding frame within the pipeline 1150. The analysis block 1043 addresses this mismatch by providing a fourth control signal $C_{1007}$ that has a value to configure the time-frequency resolution transformation modification block 1007 to modify the time-frequency resolution of the high frequency band according to the process of FIG. 9 so as to match the optimal time-frequency resolution determined for the high frequency band of the current encoding frame by the analysis block 1043.

Decoder

Figure 16:
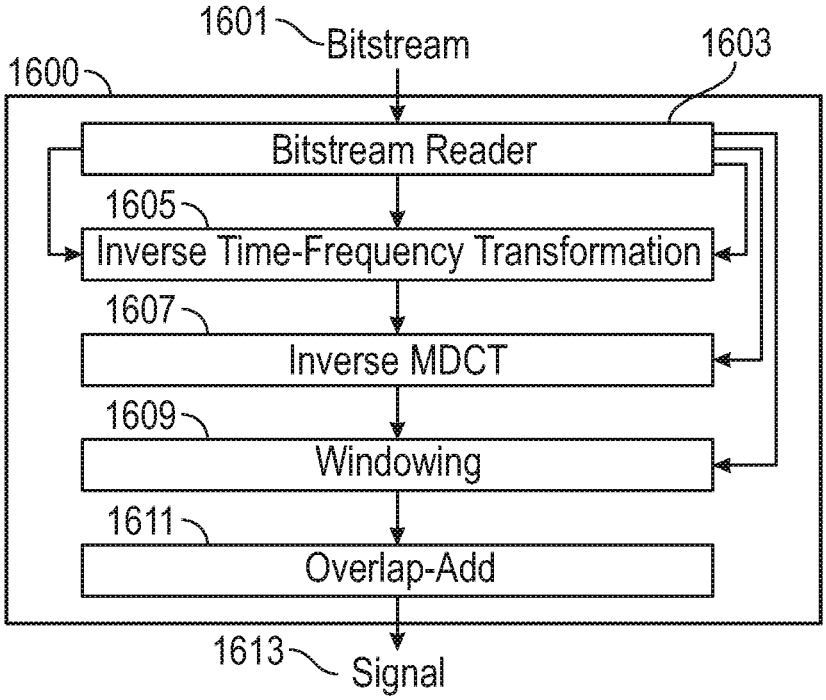
FIG. 16 is an illustrative block diagram of an audio decoder in accordance with some embodiments.

FIG. 16 is an illustrative block diagram of an audio decoder 1600 in accordance with some embodiments. A bitstream 1601 may be received and parsed by the bitstream reader 1603. The bitstream reader may process the bitstream successively in portions that comprise one frame of audio data. Transform data corresponding to one frame of audio data may be provided to the inverse time-frequency transformation block 1605. Control data from the bitstream may be provided from the bitstream reader 1603 to the inverse time-frequency transformation block 1605 to indicate which inverse time-frequency transformations to carry out on the frame of transform data. The output of block 1605 is then processed by the inverse MDCT block 1607, which may receive control information from the bitstream reader 1603. The control information may include the MDCT transform size for the frame of audio data. Block 1607 may carry out one or more inverse MDCTs in accordance with the control information. The output of block 1607 may be one or more time-domain segments corresponding to results of the one or more inverse MDCTs carried out in block 1607. The output of block 1607 is then processed by the windowing block 1609, which may apply a window to each of the one or more time-domain segments output by block 1607 to generate one or more windowed time-domain segments. The one or more windowed segments generated by block 1609 are provided to overlap-add block 1611 to reconstruct the output signal 1613. The reconstruction may incorporate windowed segments generated from previous frames of audio data.

Example Hardware Implementation

Figure 17:
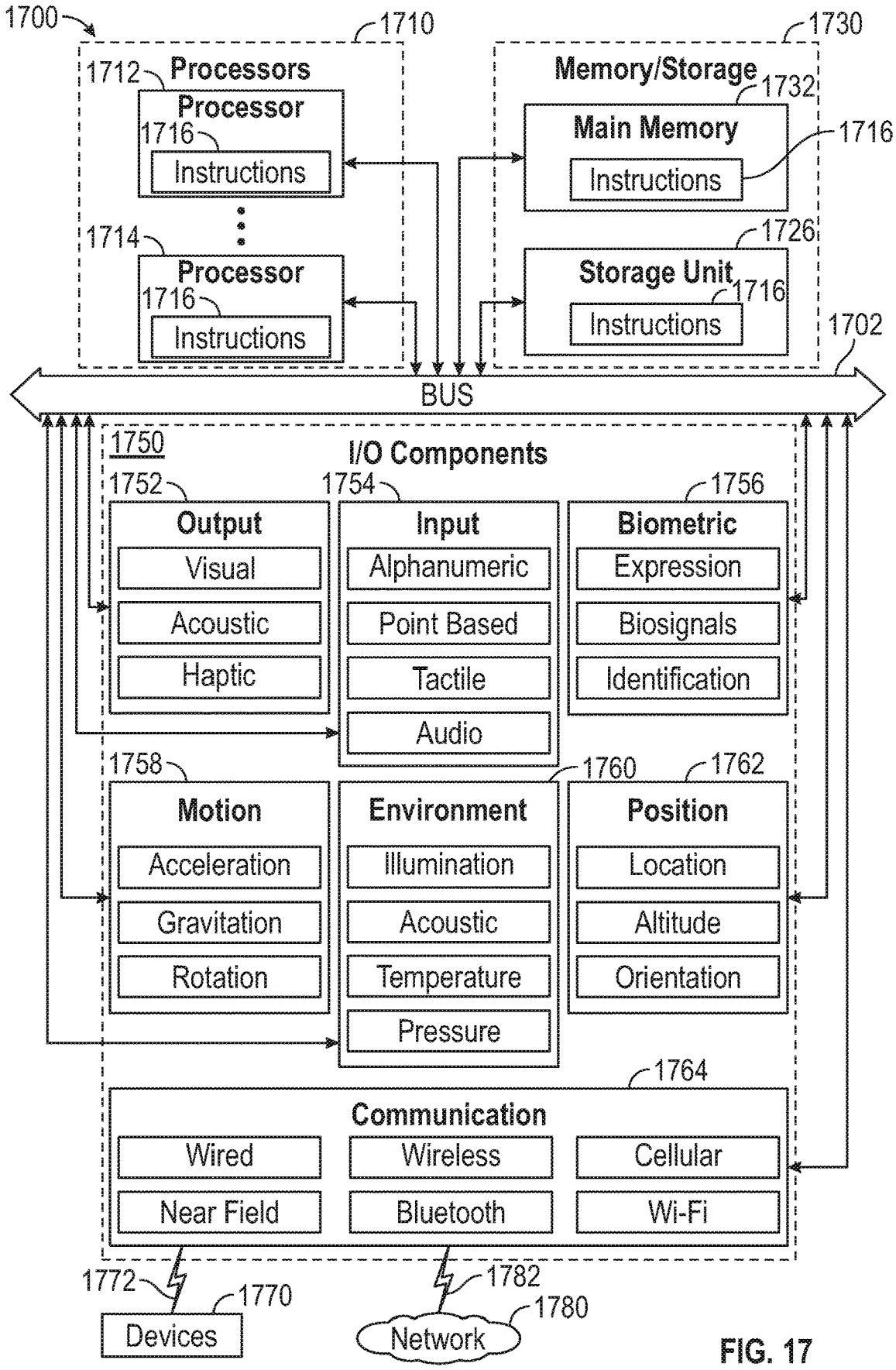
FIG. 17 is an illustrative block diagram illustrating components of a machine, according to some example embodiments, able to read instructions from a machine-readable medium and perform any one or more of the methodologies discussed herein.

FIG. 17 is an illustrative block diagram illustrating components of a machine 1700, according to some example embodiments, able to read instructions 1716 from a machine-readable medium (e.g., a machine-readable storage medium) and perform any one or more of the methodologies discussed herein. Specifically, FIG. 17 shows a diagrammatic representation of the machine 1700 in the example form of a computer system, within which the instructions 1716 (e.g., software, a program, an application, an applet, an app, or other executable code) for causing the machine 1700 to perform any one or more of the methodologies discussed herein may be executed. For example, the instructions 1716 can configure a processor 1710 to implement modules or circuits or components of FIGS. 4, 10A, 10B, 10C, 11C1-11C4 and 16, for example. The instructions 1716 can transform the general, non-programmed machine 1700 into a particular machine programmed to carry out the described and illustrated functions in the manner described (e.g., as an audio processor circuit). In alternative embodiments, the machine 1700 operates as a standalone device or can be coupled (e.g., networked) to other machines. In a networked deployment, the machine 1700 can operate in the capacity of a server machine or a client machine in a server-client network environment, or as a peer machine in a peer-to-peer (or distributed) network environment.

The machine 1700 can comprise, but is not limited to, a server computer, a client computer, a personal computer (PC), a tablet computer, a laptop computer, a netbook, a set-top box (STB), a personal digital assistant (PDA), an entertainment media system or system component, a cellular telephone, a smart phone, a mobile device, a wearable device (e.g., a smart watch), a smart home device (e.g., a smart appliance), other smart devices, a web appliance, a network router, a network switch, a network bridge, a headphone driver, or any machine capable of executing the instructions 1716, sequentially or otherwise, that specify actions to be taken by the machine 1700. Further, while only a single machine 1700 is illustrated, the term "machine" shall also be taken to include a collection of machines 1700 that individually or jointly execute the instructions 1716 to perform any one or more of the methodologies discussed herein.

The machine 1700 can include or use processors 1710, such as including an audio processor circuit, non-transitory memory/storage 1730, and I/O components 1750, which can be configured to communicate with each other such as via a bus 1702. In an example embodiment, the processors 1710 (e.g., a central processing unit (CPU), a reduced instruction set computing (RISC) processor, a complex instruction set computing (CISC) processor, a graphics processing unit (GPU), a digital signal processor (DSP), an ASIC, a radio-frequency integrated circuit (RFIC), another processor, or any suitable combination thereof) can include, for example, a circuit such as a processor 1712 and a processor 1714 that may execute the instructions 1716. The term "processor" is intended to include a multi-core processor 1712, 1714 that can comprise two or more independent processors 1712, 1714 (sometimes referred to as "cores") that may execute the instructions 1716 contemporaneously. Although FIG. 17 shows multiple processors 1710, the machine 1100 may include a single processor 1712, 1714 with a single core, a single processor 1712, 1714 with multiple cores (e.g., a multi-core processor 1712, 1714), multiple processors 1712, 1714 with a single core, multiple processors 1712, 1714 with multiples cores, or any combination thereof, wherein any one or more of the processors can include a circuit configured to apply a height filter to an audio signal to render a processed or virtualized audio signal.

The memory/storage 1730 can include a memory 1732, such as a main memory circuit, or other memory storage circuit, and a storage unit 1136, both accessible to the processors 1710 such as via the bus 1702. The storage unit 1736 and memory 1732 store the instructions 1716 embodying any one or more of the methodologies or functions described herein. The instructions 1716 may also reside, completely or partially, within the memory 1732, within the storage unit 1736, within at least one of the processors 1710 (e.g., within the cache memory of processor 1712, 1714), or any suitable combination thereof, during execution thereof by the machine 1700. Accordingly, the memory 1732, the storage unit 1736, and the memory of the processors 1710 are examples of machine-readable media.

As used herein, "machine-readable medium" means a device able to store the instructions 1716 and data temporarily or permanently and may include, but not be limited to, random-access memory (RAM), read-only memory (ROM), buffer memory, flash memory, optical media, magnetic media, cache memory, other types of storage (e.g., erasable programmable read-only memory (EEPROM)), and/or any suitable combination thereof. The term "machine-readable medium" should be taken to include a single medium or multiple media (e.g., a centralized or distributed database, or associated caches and servers) able to store the instructions 1716. The term "machine-readable medium" shall also be taken to include any medium, or combination of multiple media, that is capable of storing instructions (e.g., instructions 1716) for execution by a machine (e.g., machine 1700), such that the instructions 1716, when executed by one or more processors of the machine 1700 (e.g., processors 1710), cause the machine 1700 to perform any one or more of the methodologies described herein. Accordingly, a "machine-readable medium" refers to a single storage apparatus or device, as well as "cloud-based" storage systems or storage networks that include multiple storage apparatus or devices. The term "machine-readable medium" excludes signals per se.

The I/O components 1750 may include a variety of components to receive input, provide output, produce output, transmit information, exchange information, capture measurements, and so on. The specific I/O components 1750 that are included in a particular machine 1700 will depend on the type of machine 1100. For example, portable machines such as mobile phones will likely include a touch input device or other such input mechanisms, while a headless server machine will likely not include such a touch input device. It will be appreciated that the I/O components 1750 may include many other components that are not shown in FIG. 10. The I/O components 1750 are grouped by functionality merely for simplifying the following discussion, and the grouping is in no way limiting. In various example embodiments, the I/O components 1750 may include output components 1752 and input components 1754. The output components 1752 can include visual components (e.g., a display such as a plasma display panel (PDP), a light emitting diode (LED) display, a liquid crystal display (LCD), a projector, or a cathode ray tube (CRT)), acoustic components (e.g., loudspeakers), haptic components (e.g., a vibratory motor, resistance mechanisms), other signal generators, and so forth. The input components 1754 can include alphanumeric input components (e.g., a keyboard, a touch screen configured to receive alphanumeric input, a photo-optical keyboard, or other alphanumeric input components), point based input components (e.g., a mouse, a touchpad, a trackball, a joystick, a motion sensor, or other pointing instruments), tactile input components (e.g., a physical button, a touch screen that provides location and/or force of touches or touch gestures, or other tactile input components), audio input components (e.g., a microphone), and the like.

In further example embodiments, the I/O components 1750 can include biometric components 1756, motion components 1758, environmental components 1760, or position components 1762, among a wide array of other components. For example, the biometric components 1756 can include components to detect expressions (e.g., hand expressions, facial expressions, vocal expressions, body gestures, or eye tracking), measure biosignals (e.g., blood pressure, heart rate, body temperature, perspiration, or brain waves), identify a person (e.g., voice identification, retinal identification, facial identification, fingerprint identification, or electroencephalogram based identification), and the like, such as can influence a inclusion, use, or selection of a listener-specific or environment-specific impulse response or HRTF, for example. In an example, the biometric components 1156 can include one or more sensors configured to sense or provide information about a detected location of the listener in an environment. The motion components 1758 can include acceleration sensor components (e.g., accelerometer), gravitation sensor components, rotation sensor components (e.g., gyroscope), and so forth, such as can be used to track changes in the location of the listener. The environmental components 1760 can include, for example, illumination sensor components (e.g., photometer), temperature sensor components (e.g., one or more thermometers that detect ambient temperature), humidity sensor components, pressure sensor components (e.g., barometer), acoustic sensor components (e.g., one or more microphones that detect reverberation decay times, such as for one or more frequencies or frequency bands), proximity sensor or room volume sensing components (e.g., infrared sensors that detect nearby objects), gas sensors (e.g., gas detection sensors to detect concentrations of hazardous gases for safety or to measure pollutants in the atmosphere), or other components that may provide indications, measurements, or signals corresponding to a surrounding physical environment. The position components 1762 can include location sensor components (e.g., a Global Position System (GPS) receiver component), altitude sensor components (e.g., altimeters or barometers that detect air pressure from which altitude may be derived), orientation sensor components (e.g., magnetometers), and the like.

Communication can be implemented using a wide variety of technologies. The I/O components 1750 can include communication components 1764 operable to couple the machine 1700 to a network 1780 or devices 1770 via a coupling 1782 and a coupling 1772 respectively. For example, the communication components 1764 can include a network interface component or other suitable device to interface with the network 1780. In further examples, the communication components 1764 can include wired communication components, wireless communication components, cellular communication components, near field communication (NFC) components, Bluetooth® components (e.g., Bluetooth® Low Energy), Wi-Fi® components, and other communication components to provide communication via other modalities. The devices 1770 can be another machine or any of a wide variety of peripheral devices (e.g., a peripheral device coupled via a USB).

Moreover, the communication components 1764 can detect identifiers or include components operable to detect identifiers. For example, the communication components 1764 can include radio frequency identification (RFID) tag reader components, NFC smart tag detection components, optical reader components (e.g., an optical sensor to detect one-dimensional bar codes such as Universal Product Code (UPC) bar code, multi-dimensional bar codes such as Quick Response (QR) code, Aztec code, Data Matrix, Dataglyph, MaxiCode, PDF49, Ultra Code, UCC RSS-2D bar code, and other optical codes), or acoustic detection components (e.g., microphones to identify tagged audio signals). In addition, a variety of information can be derived via the communication components 1064, such as location via Internet Protocol (IP) geolocation, location via Wi-Fi® signal triangulation, location via detecting an NFC beacon signal that may indicate a particular location, and so forth. Such identifiers can be used to determine information about one or more of a reference or local impulse response, reference or local environment characteristic, or a listener-specific characteristic.

In various example embodiments, one or more portions of the network 1780 can be an ad hoc network, an intranet, an extranet, a virtual private network (VPN), a local area network (LAN), a wireless LAN (WLAN), a wide area network (WAN), a wireless WAN (WWAN), a metropolitan area network (MAN), the Internet, a portion of the Internet, a portion of the public switched telephone network (PSTN), a plain old telephone service (POTS) network, a cellular telephone network, a wireless network, a Wi-Fi@ network, another type of network, or a combination of two or more such networks. For example, the network 1780 or a portion of the network 1080 can include a wireless or cellular network and the coupling 1082 may be a Code Division Multiple Access (CDMA) connection, a Global System for Mobile communications (GSM) connection, or another type of cellular or wireless coupling. In this example, the coupling 1782 can implement any of a variety of types of data transfer technology, such as Single Carrier Radio Transmission Technology (1×RTT), Evolution-Data Optimized (EVDO) technology, General Packet Radio Service (GPRS) technology, Enhanced Data rates for GSM Evolution (EDGE) technology, third Generation Partnership Project (3GPP) including 3G, fourth generation wireless (4G) networks, Universal Mobile Telecommunications System (UMTS), High Speed Packet Access (HSPA), Worldwide Interoperability for Microwave Access (WiMAX), Long Term Evolution (LTE) standard, others defined by various standard-setting organizations, other long range protocols, or other data transfer technology. In an example, such a wireless communication protocol or network can be configured to transmit headphone audio signals from a centralized processor or machine to a headphone device in use by a listener.

The instructions 1716 can be transmitted or received over the network 1780 using a transmission medium via a network interface device (e.g., a network interface component included in the communication components 1064) and using any one of a number of well-known transfer protocols (e.g., hypertext transfer protocol (HTTP)). Similarly, the instructions 1716 can be transmitted or received using a transmission medium via the coupling 1772 (e.g., a peer-to-peer coupling) to the devices 1770. The term "transmission medium" shall be taken to include any intangible medium that is capable of storing, encoding, or carrying the instructions 1716 for execution by the machine 1700, and includes digital or analog communications signals or other intangible media to facilitate communication of such software.

VARIOUS EXAMPLES

Example 1 can include a method of encoding an audio signal comprising: receiving the audio signal frame (frame);

applying multiple different time-frequency transforms to the frame across a frequency spectrum to produce multiple transforms of the frame, each transform having a corresponding time-frequency resolution across the frequency spectrum; computing measures of coding efficiency for multiple frequency bands within the frequency spectrum, for multiple time-frequency resolutions corresponding to the multiple transforms; selecting a combination of time-frequency resolutions to represent the frame at each of the multiple frequency bands within the frequency spectrum, based at least in part upon the computed measures of coding efficiency; determining a window size and a corresponding transform size for the frame, based at least in part upon the selected combination of time-frequency resolutions; determining a modification transformation for at least a one of the frequency bands based at least in part upon the selected combination of time-frequency resolutions and the determined window size; windowing the frame using the determined window size to produce a windowed frame; transforming the windowed frame using the determined transform size to produce a transform of the windowed frame that has a corresponding time-frequency resolution at each of the multiple frequency bands of the frequency spectrum; modifying a time-frequency resolution within at least one frequency band of the transform of the windowed frame based at least in part upon the determined modification transformation.

Example 2 can include, or can optionally be combined with the subject matter of Example 1, wherein each corresponding time-frequency resolution across the frequency spectrum corresponds to a corresponding set of coefficients across the frequency spectrum; wherein the combination of time-frequency resolutions selected to represent the frame includes for each of the multiple frequency bands a subset of each corresponding set of coefficients; and wherein the computed corresponding measures of coding efficiency provide measures of coding efficiency of the corresponding subsets of coefficients.

Example 3 can include, or can optionally be combined with the subject matter of Example 2, wherein computing measures of coding efficiency includes computing measures based upon a combination of data rate and error rate.

Example 4 can include, or can optionally be combined with the subject matter of Example 2, wherein computing measures of coding efficiency includes computing measures based upon the sparsity of the coefficients.

Example 5 can include, or can optionally be combined with the subject matter of Example, wherein determining the modification transformation for the at least a one of the frequency bands includes determining based at least in part upon a difference between a time-frequency resolution selected to represent the frame in the at least a one of the frequency bands and a time-frequency resolution corresponding to the determined window size.

Example 6 can include, or can optionally be combined with the subject matter of Example 1, wherein modifying the time-frequency resolution within the at least one frequency band of the transform of the windowed frame includes modifying time-frequency resolution within at least one frequency band of the transform of the windowed frame to match a time-frequency resolution selected to represent the frame in the at least a one of the frequency bands.

Example 7 can include, or can optionally be combined with the subject matter of Example 1, wherein determining the modification transformation for the at least a one of the frequency bands includes determining based at least in part upon a difference between a time-frequency resolution selected to represent the frame in the at least a one of the frequency bands and a time-frequency resolution corresponding to the determined window size; and wherein modifying the time-frequency resolution within the at least one frequency band of the transform of the windowed frame includes modifying a time-frequency resolution within the at least one frequency band of the transform of the windowed frame to match the time-frequency resolution selected to represent the frame in the at least a one of the frequency bands.

Example 8 can include, or can optionally be combined with the subject matter of Example 1, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing the measures of coding efficiency for the multiple frequency bands across the frequency spectrum includes determining respective measures of coding efficiency for multiple respective combinations of subsets of coefficients, each respective combination of coefficients having a subset of coefficients from each set of corresponding coefficients in each frequency band.

Example 9 can include, or can optionally be combined with the subject matter of Example 8, wherein selecting the combination of time-frequency resolutions includes comparing the determined respective measures of coding efficiency for multiple respective combinations of subsets of coefficients.

Example 10 can include, or can optionally be combined with the subject matter of Example 1, wherein each corresponding time-frequency resolution across the frequency spectrum corresponds to a corresponding set of coefficients across the frequency spectrum; further including:

grouping each corresponding set of coefficients into corresponding subsets of coefficients for each of the multiple frequency bands within the frequency spectrum;

wherein computing a measure of coding efficiency for the multiple frequency bands across the frequency spectrum includes using a trellis structure to compute the measures of coding efficiency, wherein a node of the trellis structure corresponds to one of the subsets of coefficients and a column of the trellis structure corresponds to one of the multiple frequency bands.

Example 11 can include, or can optionally be combined with the subject matter of Example 10, wherein respective measures of coding efficiency include respective transition costs associated with respective transition paths between nodes in different columns of the trellis structure.

Example 12 can include a method of encoding an audio signal comprising: receiving, a sequence of audio signal frames (frames), wherein the sequence of frames includes an audio frame received before one or more other frames of the sequence; designating the audio frame received before one or more other frames of the sequence as the encoding frame; applying multiple different time-frequency transforms to each respective received frame across a frequency spectrum to produce for each respective frame multiple transforms of the respective frame, each transform of the respective frame having a corresponding time-frequency resolution of the respective frame across the frequency spectrum; computing measures of coding efficiency of the sequence of received frames across multiple frequency bands within the frequency spectrum, for multiple time-frequency resolutions of the respective frames corresponding to the multiple transforms of the respective frames; selecting a combination of time-frequency resolutions to represent the encoding frame at each of the multiple frequency bands within the frequency spectrum, based at least in part upon the computed measures of coding efficiency; determining a window size and a corresponding transform size for the encoding frame, based at least in part upon the combination of time-frequency resolutions selected to represent the encoding frame; determining a modification transformation for at least a one of the frequency bands based at least in part upon the selected combination of time-frequency resolutions for the encoding frame and the determined window size; windowing the encoding frame using the determined window size to produce a windowed frame; transforming the windowed encoding frame using the determined transform size to produce a transform of the windowed encoding frame that has a corresponding time-frequency resolution at each of the multiple frequency bands of the frequency spectrum; and modifying a time-frequency resolution within at least one frequency band of the transform of the windowed encoding frame based at least in part upon the determined modification transformation.

Example 13 can include, or can optionally be combined with the subject matter of Example 12, wherein each corresponding time-frequency resolution across the frequency spectrum corresponds to a corresponding set of coefficients across the frequency spectrum; wherein the combination of time-frequency resolutions selected to represent the encoding frame includes for each of the multiple frequency bands a subset of each corresponding set of coefficients; and wherein the computed measures of coding efficiency provide measures of coding efficiency of the corresponding subsets of coefficients.

Example 14 can include, or can optionally be combined with the subject matter of Example 13, wherein computing measures of coding efficiency includes computing measures based upon a combination of data rate and error rate.

Example 15 can include, or can optionally be combined with the subject matter of Example 13, wherein computing measures of coding efficiency includes computing measures based upon sparsity of coefficients.

Example 16 can include, or can optionally be combined with the subject matter of Example 12, wherein determining the modification transformation for the at least a one of the frequency bands includes determining based at least in part upon a difference between a time-frequency resolution selected to represent the encoding frame in the at least a one of the frequency bands and a time-frequency resolution corresponding to the determined window size.

Example 17 can include, or can optionally be combined with the subject matter of Example 12, wherein modifying the time-frequency resolution within the at least one frequency band of the transform of the windowed encoding frame includes modifying time-frequency resolution within at least one frequency band of the transform of the windowed encoding frame to match a time-frequency resolution selected to represent the encoding frame in the at least a one of the frequency bands.

Example 18 can include, or can optionally be combined with the subject matter of Example 12, wherein determining the modification transformation for the at least a one of the frequency bands includes determining based at least in part upon a difference between a time-frequency resolution selected to represent the encoding frame in the at least a one of the frequency bands and a time-frequency resolution corresponding to the determined window size; and wherein modifying the time-frequency resolution within the at least one frequency band of the transform of the windowed encoding frame includes modifying a time-frequency resolution within the at least one frequency band of the transform of the windowed encoding frame to match the time-frequency resolution selected to represent the encoding frame in the at least a one of the frequency bands.

Example 19 can include, or can optionally be combined with the subject matter of Example 12, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing the measures of coding efficiency for the multiple frequency bands across the frequency spectrum includes determining respective measures of coding efficiency for multiple respective combinations of subsets of coefficients, each respective combination of coefficients having a subset of coefficients from each corresponding set of coefficients in each frequency band.

Example 20 can include, or can optionally be combined with the subject matter of Example 19, wherein selecting the combination of time-frequency resolutions includes comparing the determined respective measures of coding efficiency for multiple respective combinations of subsets of coefficients.

Example 21 can include, or can optionally be combined with the subject matter of Example 12, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing a measure of coding efficiency for the multiple frequency bands across the frequency spectrum includes using a trellis structure that includes a plurality of nodes arranged in rows and columns to compute the measures of coding efficiency, wherein a node of the trellis structure corresponds to one of the subsets of coefficients for one of the multiple frequency bands and a column of the trellis structure corresponds to one of the frames of the sequence of frames.

Example 22 can include, or can optionally be combined with the subject matter of Example 21, wherein computing measures of coding efficiency includes determining respective transition costs associated with respective transition paths between nodes of the trellis structure.

Example 23 can include, or can optionally be combined with the subject matter of Example 12, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing a measure of coding efficiency for the multiple frequency bands across the frequency spectrum includes using multiple trellis structures to compute the measures of coding efficiency, wherein each trellis structure corresponds to a different one of the multiple frequency bands, wherein each trellis structure includes a plurality of nodes arranged in rows and columns, wherein each column of each trellis structure corresponds to one of the frames of the sequence of frames, and wherein each node of each respective trellis structure corresponds to one of the subsets of coefficients for the frequency band corresponding to that trellis structure.

Example 24 can include, or can optionally be combined with the subject matter of Example 23, wherein computing measures of coding efficiency includes computing respective transition costs associated with respective transition paths between nodes of the respective trellis structures.

Example 25 can include audio encoder comprising: applying multiple different time-frequency transforms to the frame across a frequency spectrum to produce multiple transforms of the frame, each transform having a corresponding time-frequency resolution across the frequency spectrum; computing measures of coding efficiency for multiple frequency bands within the frequency spectrum, for multiple time-frequency resolutions corresponding to the multiple transforms; selecting a combination of time-frequency resolutions to represent the frame at each of the multiple frequency bands within the frequency spectrum, based at least in part upon the computed measures of coding efficiency; determining a window size and a corresponding transform size for the frame, based at least in part upon the selected combination of time-frequency resolutions; determining a modification transformation for at least one of the frequency bands based at least in part upon the selected combination of time-frequency resolutions and the determined window size; windowing the frame using the determined window size to produce a windowed frame; transforming the windowed frame using the determined transform size to produce a transform of the windowed frame that has a corresponding time-frequency resolution at each of the multiple frequency bands of the frequency spectrum; modifying a time-frequency resolution within at least one frequency band of the transform of the windowed frame based at least in part upon the determined modification transformation.

Example 26 can include, or can optionally be combined with the subject matter of Example 25, wherein each corresponding time-frequency resolution across the frequency spectrum corresponds to a corresponding set of coefficients across the frequency spectrum; wherein the combination of time-frequency resolutions selected to represent the frame includes for each of the multiple frequency bands a subset of each corresponding set of coefficients; and wherein the computed corresponding measures of coding efficiency provide measures of coding efficiency of the corresponding subsets of coefficients.

Example 27 can include, or can optionally be combined with the subject matter of Example 26, wherein computing measures of coding efficiency includes computing measures based upon a combination of data rate and error rate.

Example 28 can include, or can optionally be combined with the subject matter of Example 26, wherein computing measures of coding efficiency includes computing measures based upon the sparsity of the coefficients.

Example 29 can include, or can optionally be combined with the subject matter of Example 25, wherein determining the modification transformation for the at least a one of the frequency bands includes determining based at least in part upon a difference between a time-frequency resolution selected to represent the frame in the at least a one of the frequency bands and a time-frequency resolution corresponding to the determined window size.

Example 30 can include, or can optionally be combined with the subject matter of Example 25, wherein modifying the time-frequency resolution within the at least one frequency band of the transform of the windowed frame includes modifying time-frequency resolution within at least one frequency band of the transform of the windowed frame to match a time-frequency resolution selected to represent the frame in the at least a one of the frequency bands.

Example 31 can include, or can optionally be combined with the subject matter of Example 25, wherein determining the modification transformation for the at least a one of the frequency bands includes determining based at least in part upon a difference between a time-frequency resolution selected to represent the frame in the at least a one of the frequency bands and a time-frequency resolution corresponding to the determined window size; and wherein modifying the time-frequency resolution within the at least one frequency band of the transform of the windowed frame includes modifying a time-frequency resolution within the at least one frequency band of the transform of the windowed frame to match the time-frequency resolution selected to represent the frame in the at least a one of the frequency bands.

Example 32 can include, or can optionally be combined with the subject matter of Example 25, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing the measures of coding efficiency for the multiple frequency bands across the frequency spectrum includes determining respective measures of coding efficiency for multiple respective combinations of subsets of coefficients, each respective combination of coefficients having a subset of coefficients from each set of corresponding coefficients in each frequency band.

Example 33 can include, or can optionally be combined with the subject matter of Example 32, wherein selecting the combination of time-frequency resolutions includes comparing the determined respective measures of coding efficiency for multiple respective combinations of subsets of coefficients.

Example 34 can include, or can optionally be combined with the subject matter of Example 25, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum;

wherein computing a measure of coding efficiency for the multiple frequency bands across the frequency spectrum includes using a trellis structure to compute the measures of coding efficiency, wherein a node of the trellis structure corresponds to one of the subsets of coefficients and a column of the trellis structure corresponds to one of the multiple frequency bands.

Example 35 can include, or can optionally be combined with the subject matter of Example 34, wherein respective measures of coding efficiency include respective transition costs associated with respective transition paths between nodes in different columns of the trellis structure.

Example 36 can include an Example audio encoder comprising: at least one processor; one or more computer-readable mediums storing instructions that, when executed by the one or more computer processors, cause the system to perform operations comprising: receiving, a sequence of audio signal frames (frames), wherein the sequence of frames includes an audio frame received before one or more other frames of the sequence; designating the audio frame received before one or more other frames of the sequence as the encoding frame; applying multiple different time-frequency transforms to each respective received frame across a frequency spectrum to produce for each respective frame multiple transforms of the respective frame, each transform of the respective frame having a corresponding time-frequency resolution of the respective frame across the frequency spectrum; computing measures of coding efficiency of the sequence of received frames across multiple frequency bands within the frequency spectrum, for multiple time-frequency resolutions of the respective frames corresponding to the multiple transforms of the respective frames; selecting a combination of time-frequency resolutions to represent the encoding frame at each of the multiple frequency bands within the frequency spectrum, based at least in part upon the computed measures of coding efficiency; determining a window size and a corresponding transform size for the encoding frame, based at least in part upon the combination of time-frequency resolutions selected to represent the encoding frame; determining a modification transformation for at least a one of the frequency bands based at least in part upon the selected combination of time-frequency resolutions for the encoding frame and the determined window size; windowing the encoding frame using the determined window size to produce a windowed frame; transforming the windowed encoding frame using the determined transform size to produce a transform of the windowed encoding frame that has a corresponding time-frequency resolution at each of the multiple frequency bands of the frequency spectrum; and modifying a time-frequency resolution within at least one frequency band of the transform of the windowed encoding frame based at least in part upon the determined modification transformation.

Example 37 can include, or can optionally be combined with the subject matter of Example 36, wherein each corresponding time-frequency resolution across the frequency spectrum corresponds to a corresponding set of coefficients across the frequency spectrum; wherein the combination of time-frequency resolutions selected to represent the encoding frame includes for each of the multiple frequency bands a subset of each corresponding set of coefficients; and wherein the computed measures of coding efficiency provide measures of coding efficiency of the corresponding subsets of coefficients.

Example 38 can include, or can optionally be combined with the subject matter of Example 37, wherein computing measures of coding efficiency includes computing measures based upon a combination of data rate and error rate.

Example 39 can include, or can optionally be combined with the subject matter of Example 37, wherein computing measures of coding efficiency includes computing measures based upon sparsity of wherein determining the modification transformation for the at least a one of the frequency bands includes determining based at least in part upon a difference between a time-frequency resolution selected to represent the encoding frame in the at least a one of the frequency bands and a time-frequency resolution corresponding to the determined window size.

Example 40 can include, or can optionally be combined with the subject matter of Example 36, wherein modifying the time-frequency resolution within the at least one frequency band of the transform of the windowed encoding frame includes modifying time-frequency resolution within at least one frequency band of the transform of the windowed encoding frame to match a time-frequency resolution selected to represent the encoding frame in the at least a one of the frequency bands.

Example 41 can include, or can optionally be combined with the subject matter of Example 36, wherein determining the modification transformation for the at least a one of the frequency bands includes determining based at least in part upon a difference between a time-frequency resolution selected to represent the encoding frame in the at least a one of the frequency bands and a time-frequency resolution corresponding to the determined window size; and wherein modifying the time-frequency resolution within the at least one frequency band of the transform of the windowed encoding frame includes modifying a time-frequency resolution within the at least one frequency band of the transform of the windowed encoding frame to match the time-frequency resolution selected to represent the encoding frame in the at least a one of the frequency bands.

Example 42 can include, or can optionally be combined with the subject matter of Example 36, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing the measures of coding efficiency for the multiple frequency bands across the frequency spectrum includes determining respective measures of coding efficiency for multiple respective combinations of subsets of coefficients, each respective combination of coefficients having a subset of coefficients from each corresponding set of coefficients in each frequency band.

Example 43 can include, or can optionally be combined with the subject matter of Example 42, wherein selecting the combination of time-frequency resolutions includes comparing the determined respective measures of coding efficiency for multiple respective combinations of subsets of coefficients.

Example 44 can include, or can optionally be combined with the subject matter of Example 36, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing a measure of coding efficiency for the multiple frequency bands across the frequency spectrum includes using a trellis structure that includes a plurality of nodes arranged in rows and columns to compute the measures of coding efficiency, wherein a node of the trellis structure corresponds to one of the subsets of coefficients for one of the multiple frequency bands and a column of the trellis structure corresponds to one of the frames of the sequence of frames.

Example 45 can include, or can optionally be combined with the subject matter of Example 44, wherein computing measures of coding efficiency includes determining respective transition costs associated with respective transition paths between nodes of the trellis structure.

Example 46 can include, or can optionally be combined with the subject matter of Example 36, wherein each corresponding time-frequency resolution across the frequency spectrum corresponds to a corresponding set of coefficients across the frequency spectrum; further including: grouping each corresponding set of coefficients into corresponding subsets of coefficients for each of the multiple frequency bands within the frequency spectrum; wherein computing a measure of coding efficiency for the multiple frequency bands across the frequency spectrum includes using multiple trellis structures to compute the measures of coding efficiency, wherein each trellis structure corresponds to a different one of the multiple frequency bands, wherein each trellis structure includes a plurality of nodes arranged in rows and columns, wherein each column of each trellis structure corresponds to one of the frames of the sequence of frames, and wherein each node of each respective trellis structure corresponds to one of the subsets of coefficients for the frequency band corresponding to that trellis structure.

Example 47 can include, or can optionally be combined with the subject matter of Example 46, wherein computing measures of coding efficiency includes computing respective transition costs associated with respective transition paths between nodes of the respective trellis structures.

An Example 48 includes a method of decoding a coded audio signal comprising: receiving the coded audio signal frame (frame); receiving modification information; receiving transform size information; receiving window size information; modifying a time-frequency resolution within at least one frequency band of the received frame based at least in part upon the received modification information; applying an inverse transform to the modified frame based at least in part upon the received transform size information; and windowing the inverse transformed modified frame using a window size based at least in part upon the received window size information.

Example 49 can include, or can optionally be combined with the subject matter of Example 48 further including: overlap-adding the windowed inverse transformed modified frame with adjacent windowed inverse transformed modified frames.

Example 50 can include, or can optionally be combined with the subject matter of Example 48 further including: overlap-adding short windows within the windowed inverse transformed modified frame.

An Example 51 includes a method of decoding a coded audio signal comprising: receiving the coded audio signal frame (frame); receiving modification information; receiving transform size information; receiving window size information; modifying a coefficient within at least one frequency band of the received frame based at least in part upon the received modification information; applying an inverse transform to the modified frame based at least in part upon the received transform size information; and windowing the inverse transformed modified frame using a window size based at least in part upon the received window size information.

Example 52 can include, or can optionally be combined with the subject matter of Example 51 further including: overlap-adding the windowed inverse transformed modified frame with adjacent windowed inverse transformed modified frames.

Example 53 can include, or can optionally be combined with the subject matter of Example 51 further including: overlap-adding short windows within the windowed inverse transformed modified frame.

An Example 54 includes an audio decoder comprising: at least one processor; one or more computer-readable mediums storing instructions that, when executed by the one or more computer processors, cause the system to perform operations comprising: receiving the coded audio signal frame (frame); receiving modification information; receiving transform size information; receiving window size information; modifying a time-frequency resolution within at least one frequency band of the received frame based at least in part upon the received modification information; applying an inverse transform to the modified frame based upon at least in part upon the received transform size information; and windowing the inverse transformed modified frame using a window size based upon the received window size information.

Example 55 can include, or can optionally be combined with the subject matter of Example 54 further including: one or more computer-readable mediums storing instructions that, when executed by the one or more computer processors, cause the system to perform operations comprising: overlap-adding the windowed inverse transformed modified frame with adjacent windowed inverse transformed modified frame.

Example 56 can include, or can optionally be combined with the subject matter of Example 54 further including: one or more computer-readable mediums storing instructions that, when executed by the one or more computer processors, cause the system to perform operations comprising: overlap-adding short windows within the windowed inverse transformed modified frame.

An Example 57 includes audio decoder comprising: at least one processor; one or more computer-readable mediums storing instructions that, when executed by the one or more computer processors, cause the system to perform operations comprising: receiving the coded audio signal frame (frame); receiving modification information; receiving transform size information; receiving window size information; modifying a coefficient within at least one frequency band of the received frame based at least in part upon the received modification information; applying an inverse transform to the modified frame based at least in part upon the received transform size information; and windowing the inverse transformed modified frame using a window size based at least in part upon the received window size information.

Example 58 can include, or can optionally be combined with the subject matter of Example 57 further including: one or more computer-readable mediums storing instructions that, when executed by the one or more computer processors, cause the system to perform operations comprising: overlap-adding the windowed inverse transformed modified frame with adjacent windowed inverse transformed modified frame.

Example 59 can include, or can optionally be combined with the subject matter of Example 57 further including: one or more computer-readable mediums storing instructions that, when executed by the one or more computer processors, cause the system to perform operations comprising: overlap-adding short windows within the windowed inverse transformed modified frame.

The above description is presented to enable any person skilled in the art to create and use a system and method to determine window sizes and time-frequency transformations in audio coders. Various modifications to the embodiments will be readily apparent to those skilled in the art, and the generic principles defined herein may be applied to other embodiments and applications without departing from the scope of the invention. In the preceding description, numerous details are set forth for the purpose of explanation. However, one of ordinary skill in the art will realize that the invention might be practiced without the use of these specific details. In other instances, well-known processes are shown in block diagram form in order not to obscure the description of the invention with unnecessary detail. Identical reference numerals may be used to represent different views of the same or similar item in different drawings. Thus, the foregoing description and drawings of embodiments in accordance with the present invention are merely illustrative of the principles of the invention. Therefore, it will be understood that various modifications can be made to the embodiments by those skilled in the art without departing from the scope of the invention, which is defined in the appended claims.

What is claimed is:

1. A method for decoding a frame of an encoded audio signal, comprising:

receiving the frame of the encoded audio signal, wherein the frame contains subband data corresponding to a plurality of subbands, and wherein the frame contains modification information for at least one of the plurality of subbands;

modifying a time-frequency resolution within a first subband of the plurality of subbands based at least in part on the modification information to determine modified subband data for the first subband to obtain a first modified subband; and determining a decoded frame using at least the first modified subband.

2. The method of claim 1, wherein the frame further contains transform size information and wherein determining the decoded frame further comprises:

forming first transform data from at least the modified subband data; and applying an inverse transform to the first transform data based at least in part on the transform size information to determine a first time-domain signal segment for the decoded frame.

3. The method of claim 2, wherein the frame further contains window information and wherein determining the decoded frame further comprises applying a window to the first time-domain signal segment based at least in part on the window information to determine a first windowed time-domain signal segment for the decoded frame.

4. The method of claim 3, further comprising overlap-adding the first windowed time-domain signal segment with a second windowed time-domain signal segment.

5. The method of claim 4, wherein the second windowed time-domain signal segment is part of the decoded frame.

6. The method of claim 4, wherein the decoded frame is a first decoded frame and wherein the second windowed time-domain signal segment is part of a second decoded frame and is not part of the first decoded frame.

7. A method for decoding an encoded bitstream having a plurality of encoded frames, comprising:

receiving a first encoded frame of the plurality of encoded frames, wherein each of the plurality of encoded frames contains subband data for a plurality of subbands;

determining, from the first encoded frame, a first window for the first encoded frame, a first transform size for the first encoded frame, and a first set of time-frequency resolutions corresponding to the plurality of subbands in the first encoded frame;

modifying subband data for the first encoded frame based on the first set of time-frequency resolutions to obtain modified subband data for the first encoded frame;

applying an inverse transform to the modified subband data for the first encoded frame based on the first transform size to obtain inverse-transformed data for the first encoded frame;

applying a window to the inverse-transformed data for the first encoded frame based on the first window to obtain windowed data for the first encoded frame; and determining a first decoded frame based on the windowed data for the first encoded frame.

8. The method of claim 7, further comprising:

receiving a second encoded frame of the plurality of encoded frames; and determining, from the second encoded frame and the first window, a second window for the second encoded frame.

9. The method of claim 8, wherein determining the second window further comprises differentially decoding window information from the first encoded frame of the encoded bitstream and window information from the second encoded frame of the encoded bitstream.

10. The method of claim 7, further comprising:

receiving a second encoded frame of the plurality of encoded frames; and determining, from the second encoded frame and the first transform size, a second transform size for the second encoded frame.

11. The method of claim 10, wherein determining the second transform size further comprises differentially decoding transform size information from the first encoded frame of the encoded bitstream and transform size information from the second encoded frame of the encoded bitstream.

12. The method of claim 7, further comprising:

receiving a second encoded frame of the plurality of encoded frames; and determining, from the second encoded frame and the first set of time-frequency resolutions, a second set of time-frequency resolutions for the second encoded frame.

13. The method of claim 12, wherein determining the second set of time-frequency resolutions further comprises differentially decoding time-frequency resolution information from the first encoded frame of the encoded bitstream and time-frequency resolution information from the second encoded frame of the encoded bitstream.

14. The method of claim 7, wherein determining the first set of time-frequency resolutions comprises differentially decoding a time-frequency resolution index between adjacent subbands of the plurality of subbands.

15. The method of claim 7, wherein modifying subband data for the first encoded frame further comprises:

selecting a subband from the plurality of subbands to obtain a selected subband; and multiplying subband data corresponding to the selected subband by a matrix.

16. The method of claim 15, wherein the matrix is based on a time-frequency resolution corresponding to the selected subband.

17. An audio decoder, comprising:

at least one processor;

one or more computer-readable mediums storing instructions that, when executed, cause the at least one processor to perform operations comprising:

receiving a first frame of an encoded audio signal and a second frame of the encoded audio signal, wherein the first frame and the second frame each contain subband data corresponding to a plurality of subbands, modification information for at least one of the plurality of subbands, transform size information, and window information;

for the first frame, modifying a time-frequency resolution of a first subband of the plurality of subbands based at least in part on the modification information of the first frame to determine modified subband data for the first subband to obtain a first modified subband of the first frame;

for the second frame, modifying a time-frequency resolution of a second subband of the plurality of subbands based at least in part on the modification information of the second frame to determine modified subband data for the second subband to obtain a second modified subband of the second frame;

determining a first decoded frame using at least the first modified subband of the first frame; and determining a second decoded frame using at least the first second modified subband of the second frame.

18. The audio decoder of claim 17, wherein performing the operations further comprises overlap-adding the first decoded frame and the second decoded frame to determine a segment of a decoded audio signal.

19. The audio decoder of claim 17, wherein determining the second decoded frame further comprises:

determining a transform size for the second frame using the transform size information for the first frame and the transform size information for the second frame;

forming transform data for the second frame from at least the second modified subband of the second frame; and applying an inverse transform to the transform data for the second frame based at least in part on the transform size for the second frame to determine a first time-domain signal segment for the second decoded frame.

20. The audio decoder of claim 19, further comprising:

determining a first window for the second frame using the window information for the first frame and the window information for the second frame; and applying the first window to the first time-domain signal segment for the second decoded frame to determine a first windowed time-domain signal segment for the second decoded frame.

* * * * *